US009041291B2

(12) United States Patent
Neate et al.

(10) Patent No.: US 9,041,291 B2
(45) Date of Patent: May 26, 2015

(54) LAMP

(75) Inventors: Andrew Simon Neate, Aylesbury (GB); Amjid Sadiq, Aylesbury (GB)

(73) Assignee: Ceravision Limited, Milton Keynes (GB)

( * ) Notice: Subject to any disclaimer, the term of this patent is extended or adjusted under 35 U.S.C. 154(b) by 395 days.

(21) Appl. No.: 13/453,185

(22) Filed: Apr. 23, 2012

(65) Prior Publication Data

US 2012/0293067 A1 Nov. 22, 2012

Related U.S. Application Data

(63) Continuation-in-part of application No. 12/227,752, filed on Apr. 7, 2009, now Pat. No. 8,164,264.

(51) Int. Cl.
*H01J 65/04* (2006.01)
*H01Q 1/26* (2006.01)

(52) U.S. Cl.
CPC ..... *H01J 65/044* (2013.01); *H01Q 1/26* (2013.01)

(58) Field of Classification Search
USPC ..... 315/39, 39.3, 39.51, 39.55, 41, 44
See application file for complete search history.

(56) References Cited

U.S. PATENT DOCUMENTS

| | | | | |
|---|---|---|---|---|
| 4,607,242 | A | 8/1986 | Cozzie | |
| 6,737,809 | B2 | 5/2004 | Espiau et al. | |
| 6,949,887 | B2 | 9/2005 | Kirkpatrick et al. | |
| 8,739,149 | B2 * | 5/2014 | Tackett et al. | 717/168 |
| 2002/0011802 | A1 | 1/2002 | Espiau et al. | |
| 2008/0203922 | A1 | 8/2008 | Guthrie | |
| 2010/0156295 | A1 * | 6/2010 | Park et al. | 315/39 |

* cited by examiner

*Primary Examiner* — Douglas W Owens
*Assistant Examiner* — Thai Pham
(74) *Attorney, Agent, or Firm* — Bay State IP, LLC

(57) ABSTRACT

A band pass filter comprises an air filled aluminum chamber, having a lid and a cuboid resonant cavity having a central iris. At opposite end nodes of the cavity, perfect electric conductors (PECs) are provided. One is connected to a feed wire from an input at one end of the cavity. The other PEC is connected via a further feed wire to a radiator in a fabrication of solid-dielectric, lucent material.

Threaded tuning projections opposite the PECs and in the iris are provided, whereby the pass band and the transmission characteristics of the filter in the pass band can be tuned to match the input impedance of the band pass filter and the wave guide to the output impedance of a microwave drive circuit (not shown). Typically the impedance will be 50Ω.

48 Claims, 13 Drawing Sheets

LAMP

CROSS-REFERENCE TO RELATED APPLICATIONS

This application is a Continuation-in-part application, which takes the benefit of and claims priority from U.S. application Ser. No. 12/227,752 filed on Apr. 7, 2009 now U.S. Pat. No. 8,164,264, the contents of which are hereby incorporated by reference.

BACKGROUND OF THE INVENTION

1. Field of the Invention

The present invention relates to a lamp to be driven from a source of microwave energy and having an electrodeless plasma discharge.

In the Parent application Ser. No. 12/227,750, the plasma discharge is in a bulb in a ceramic receptacle. In this Continuation in Part, the bulb and the ceramic receptacle are replaced by a two-region/two-volume arrangement.

Efficient coupling of microwave energy into the bulb is crucial to strongly exciting the contents of the bulb, to cause it to incandesce. For this reason, air wave guides have not been successful for this purpose.

2. Description of the Related Art

In U.S. Pat. No. 6,737,809, in the name of F M Espiau et al., there is described:

A dielectric waveguide integrated plasma lamp with a body consisting essentially of at least one dielectric material having a dielectric constant greater than approximately 2, and having a shape and dimensions such that the body resonates in at least one resonant mode when microwave energy of an appropriate frequency is coupled into the body. A bulb positioned in a cavity within the body contains a gas-fill which when receiving energy from the resonating body forms a light-emitting plasma. (Despite reference to a "bulb", this specification does not describe a discrete bulb, separable from the lamp body.)

In our European Patent No. EP2188829—Our '829 patent, there is described and claimed (as granted):

A light source to be powered by microwave energy, the source having:

- a body having a sealed void therein,
  - a microwave-enclosing Faraday cage surrounding the body,
- the body within the Faraday cage being a resonant waveguide,
- a fill in the void of material excitable by microwave energy to form a light emitting plasma therein, and
- an antenna arranged within the body for transmitting plasma-inducing, microwave energy to the fill, the antenna having:
  - a connection extending outside the body for coupling to a source of microwave energy;

wherein:

- the body is a solid plasma crucible of material which is lucent for exit of light therefrom, and
- the Faraday cage is at least partially light transmitting for light exit from the plasma crucible, the arrangement being such that light from a plasma in the void can pass through the plasma crucible and radiate from it via the cage.

As used in Our '829 patent:

"lucent" means that the material, of the item which is described as lucent, is transparent or translucent—this meaning is also used in the present specification in respect of its invention;

"plasma crucible" means a closed body enclosing a plasma, the latter being in the void when the void's fill is excited by microwave energy from the antenna.

We describe the technology protected by Our '829 patent as our "LER" technology.

We have filed a series of patent applications on improvements in the LER technology.

There are certain alternatives to the LER technology, the principal one of which is known as the Clam Shell and is the subject of our International Patent Application No PCT/GB08/003,811. This describes and claims (as published):

A lamp comprising:

- a lucent waveguide of solid dielectric material having:
  - a bulb cavity,
  - an antenna re-entrant and
  - an at least partially light transmitting Faraday cage and
- a bulb having a microwave excitable fill, the bulb being received in the bulb cavity.

The LER patent, the Clam Shell application and the LER improvement applications have in common that they are in respect of:

A microwave plasma light source having:

- a of solid-dielectric, lucent material, having;
  - a closed void containing electro-magnetic wave, normally microwave, excitable material; and
- a Faraday cage:
  - delimiting a waveguide,
  - being at least partially lucent, and normally at least partially transparent, for light emission from it,
  - normally having a non-lucent closure and
  - enclosing the fabrication;
- provision for introducing plasma exciting electro-magnetic waves, normally microwaves, into the waveguide;

the arrangement being such that on introduction of electromagnetic waves, normally microwaves, of a determined frequency a plasma is established in the void and light is emitted via the Faraday cage.

In this specification, we refer to such a light source as a Lucent Waveguide Electromagnetic Wave Plasma Light Source, with the express proviso that this term is not necessarily intended to infer that the fabrication of solid-dielectric, lucent material fills the Faraday cage. Having rejected LUWAG EMPLIS as an acronym we use the abbreviated acronym LUWPL to refer to the light source of the previous paragraph. We pronounce this "loople".

For the purposes of this specification, we define "microwave" to mean the three order of magnitude range from around 300 MHz to around 300 GHz. We anticipate that the 300 MHz lower end of the microwave range is above that at which a LUWPL of the present invention could be designed to operate, i.e. operation below 300 MHz is envisaged. Nevertheless we anticipate based on our experience of reasonable dimensions that normal operation will be in the microwave range. We believe that it is unnecessary to specify a feasible operating range for the present invention.

In our existing LUWPLs, the fabrication can be of continuous solid-dielectric material between opposite sides of the Faraday cage (with the exception of the excitable-material, closed void) as in a lucent crucible of our LER technology. Alternatively it can be effectively continuous as in a bulb in a bulb cavity of the "lucent waveguide" of our Clam Shell.

Alternatively again fabrications of as yet unpublished applications on improvements in our technology include insulating spaces distinct from the excitable-material, closed void.

Accordingly it should be noted that whereas terminology in this art prior to our LER technology includes reference to an electroplated ceramic block as a waveguide and indeed the lucent crucible of our LER technology has been referred to as a waveguide; in the this specification, we use "waveguide" to indicate jointly:

- the enclosing Faraday cage, which forms the waveguide boundary,
- the solid-dielectric lucent material fabrication within the cage,
- other solid-dielectric material, if any, enclosed by the Faraday cage and
- cavities, if any, enclosed by the Faraday cage and devoid of solid dielectric material, the solid-dielectric material, together the effect of the plasma and the Faraday cage, determining the manner of propagation of the waves inside the cage.

Insofar as the lucent material may be of quartz and/or may contain glass, which materials have certain properties typical of solids and certain properties typical of liquids and as such are referred to as super-cooled liquids, super-cooled liquids are regarded as solids for the purposes of this specification.

Also for the avoidance of doubt "solid" is used in the context of the physical properties of the material concerned and not to infer that the component concerned is continuous as opposed to having voids therein.

There is a further clarification of terminology required. Historically a "Faraday cage" was an electrically conductive screen to protect occupants, animate or otherwise, from external electrical fields. With scientific advance, the term has come to mean a screen for blocking electromagnetic fields of a wide range of frequencies. A Faraday cage will not necessarily block electromagnetic radiation in the form of visible and invisible light. Insofar as a Faraday cage can screen an interior from external electromagnetic radiation, it can also retain electromagnetic radiation within itself. Its properties enabling it to do the one enable it to do the other. Whilst it is recognised that the term "Faraday cage" originates in respect of screening interiors, we have used the term in our earlier LUWPL patents and applications to refer to an electrical screen, in particular a lucent one, enclosing electromagnetic waves within a waveguide delimited by the cage. We continue with this use in this present specification.

SUMMARY OF THE INVENTION

The object of the present invention is to provide improved coupling of microwave energy to an electrodeless bulb in a lamp.

According to the invention there is provided a lamp to be driven from a source of microwave energy, the lamp comprising:

- a radiator for radiating microwave energy to the bulb,
- a fabrication of solid-dielectric, lucent material, the fabrication providing at least:
  - a closed void containing electromagnetic wave excitable plasma material;
- a Faraday cage:
  - enclosing the fabrication,
  - being at least partially lucent, for light emission from it and
  - delimiting a waveguide, the waveguide having:
    - a waveguide space, the fabrication occupying at least part of the waveguide space; and
- at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

the arrangement being such that there is:

- a first region of the waveguide space extending between opposite sides of the Faraday cage at this region, this first region:
  - accommodating the inductive coupling means and
  - having a relatively high volume average dielectric constant and
- a second region of the waveguide space extending between opposite sides of the Faraday cage at this region, this second region:
  - having a relatively low volume average dielectric constant and a microwave circuit having:

- an input for microwave energy from the source thereof and
- an output connection thereof to the radiator in the fabrication, wherein the microwave circuit is

- a capacitative-inductive circuit configured as a bandpass filter and matching output impedance of the source of microwave energy to input impedance of the circuit, receptacle and bulb combination; and is
- a tunable comb line filter; and wherein the microwave circuit comprises:

- a metallic housing;
- a pair of perfect electric conductors (PECs), each grounded inside the housing
- a pair of connections connected to the PECs, one for input and the other for output and
- a respective tuning element provided in the housing opposite the distal end of each PEC.

Whilst the preferred embodiment below the matching circuit is an air wave guide bandpass filter, it is specifically envisaged that a wave guide based on other dielectric materials may be used, for instance ceramic material. Such wave guide is described in U.S. Pat. No. 4,607,242.

Conveniently the circuit is arranged to be tunable, not only to take account of small production variations between the bulbs and the filters themselves, but also to give the filter bandwidth to include the resonant frequency of the wave guide and bulb.

An additional tuning element can be provided in the iris between the PECs.

We determine whether the coupling means is or is not "at least partially inductive" in accordance with whether or not the impedance of the light source, assessed at an input to the coupling means has an inductive component.

We can envisage certain arrangements in which the coupling means may not be totally surrounded by solid dielectric material. For instance, the coupling means may extend from solid dielectric material in the waveguide space and traverse an air gap therein. However we would not normally expect such air gap to exist.

The excitable plasma material containing void can be arranged wholly within the second, relatively low average dielectric constant region. Alternatively, it can extend through the Faraday cage and be partially without the cage and the second region.

In certain embodiments, the second region extends beyond the void in a direction from the inductive coupling means past the void. This is not the case in the first preferred embodiment described below.

Normally, the fabrication will have at least one cavity distinct from the plasma material void. In such case, the cavity can extend between an enclosure of the void and at least one peripheral wall in the fabrication, the peripheral wall having a thickness less than the extent of the cavity from the enclosure to the peripheral wall.

In a possible, but not preferred embodiment, the fabrication has at least one external dimension which is smaller than the respective dimension of the Faraday cage, the extent of the portion of the waveguide space between the fabrication and the Faraday cage being empty of solid dielectric material.

In another possible, but not preferred embodiment, the fabrication is arranged in the Faraday cage spaced from an end of the waveguide space opposite from its end at which the inductive coupler is arranged.

In another embodiment, the solid dielectric material surrounding the inductive coupling means is the same material as that of the fabrication.

In the first, preferred embodiment described below, the solid dielectric material surrounding the inductive coupling means is a material of a higher dielectric constant than that of the fabrication's material, the higher dielectric constant material being in a body surrounding the inductive coupling means and arranged adjacent to the fabrication.

Normally, the Faraday cage will be lucent for light radiation radially thereof. Also the Faraday cage is preferably lucent for light radiation forwardly thereof, that is away from the first, relatively high dielectric constant region of the waveguide space.

Again, normally the inductive coupling means will be or include an elongate antenna, which can be a plain wire extending in a bore in the body of relatively high dielectric constant material. Normally the bore will be a through bore in the said body with the antenna abutting the fabrication. A counterbore can be provided in the front face of the separate body abutting the rear face of the fabrication and the antenna is T-shaped (in profile) with its T head occupying the counterbore and abutting the fabrication.

In accordance with another aspect of the invention, there is provided a lamp to be driven from a source of microwave energy, the lamp comprising:

a radiator for radiating microwave energy to the bulb, a fabrication of solid-dielectric, lucent material, the fabrication providing at least:

an enclosure of a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space and the waveguide space having:

an axis of symmetry; and at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the arrangement is such that with the waveguide space notionally divided into equal front and rear semi-volumes:

the front semi-volume is:

at least partially occupied by the fabrication with the said void in the front semi-volume and is enclosed (except at the rear semi-volume) by a front, lucent portion of the Faraday cage via which portion light from the void can radiate, the rear semi-volume has the inductive coupler extending in it and the volume average of the dielectric constant of the content of the front semi-volume is less than that of the rear semi-volume and a microwave circuit having:

an input for microwave energy from the source thereof and an output connection thereof to the radiator in the fabrication, wherein the microwave circuit is a capacitative-inductive circuit configured as a bandpass filter and matching output impedance of the source of microwave energy to input impedance of the circuit, receptacle and bulb combination; and is a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

The difference in front and rear semi-volume volume average of dielectric constant can be caused by the said fabrication having end-to-end asymmetry and/or being asymmetrically positioned in the Faraday cage.

Preferably:

the said fabrication occupies the entire waveguide space, at least one evacuated or gas-filled cavity is included in the fabrication within the front semi-volume, thereby providing the lower volume average of dielectric constant of the front semi-volume, and the cavity extends between the enclosure of the void and at least one peripheral wall in the fabrication, the peripheral wall having a thickness less than the extent of the cavity from the enclosure of the void to the peripheral wall.

Possibly:

the said fabrication occupies a front part of the waveguide space, a separate body of the same material occupies the rest of the waveguide space and at least one evacuated or gas-filled cavity is included in the fabrication within the front semi-volume, thereby providing the lower volume average of dielectric constant of the front semi-volume, and the cavity extends between the enclosure void and at least one peripheral wall in the fabrication, the peripheral wall having a thickness less than the extent of the cavity from the enclosure of the void to the peripheral wall.

Further, preferably:

the said fabrication occupies a front part of the entire waveguide space and a separate body of higher dielectric constant material occupies the rest or at least the majority of the waveguide space.

Where a separate body is used of the same or different dielectric material to that of the fabrication, the inductive coupling means can extend beyond the rear semi-volume into the front semi-volume as far as the fabrication.

Again, preferably:

at least one evacuated or gas-filled cavity is included in the fabrication within the front semi-volume, thereby enhancing the difference in the dielectric-constant, volume averages between the front and rear semi-volumes, and the cavity extends between the enclosure of the void and at least one peripheral wall in the fabrication, the peripheral wall having a thickness less than the extent of the cavity from the enclosure of the void to the peripheral wall.

Whilst, the or each cavity can be evacuated and/or gettered, normally the or each cavity will be occupied be a gas, in particular nitrogen, at low pressure of the order of one half to one tenth of an atmosphere. Possibly the or each cavity can be open to the ambient atmosphere.

It is possible for the enclosure void to extend laterally of the cavity, crossing a central axis of the fabrication. However, normally the enclosure of the void will extend on the central longitudinal, i.e. front to rear, axis of the fabrication.

The enclosure of the void can be connected to both a rear wall and a front wall of the fabrication. However, preferably the enclosure of the void is connected to the front wall only of the fabrication.

Preferably, the enclosure of the void extends through the front wall and partially through the Faraday cage.

Possibly the front wall can be domed. However, normally the front wall will be flat and parallel to a rear wall of the fabrication.

Normally, the enclosure of the void and the rest of the fabrication will be of the same lucent material. Nevertheless, the enclosure of the void and at least outer walls of the fabrication can be of the differing lucent material. For instance, the outer walls can be of cheaper glass for instance borosilicate glass or aluminosilicate glass. Further, the outer wall(s) can be of ultraviolet opaque material.

In the preferred embodiment, the part of the waveguide space occupied by the fabrication substantially equates to the front semi-volume.

Where provided, the separate body could be spaced from the fabrication, but preferably it abuts against a rear face of the fabrication and is located laterally by the Faraday cage. The fabrication can have a skirt with the separate body both abutting a rear face of the fabrication and being located laterally within the skirt.

Preferably the void enclosure is tubular.

Preferably the fabrication and the separate body of solid dielectric material, where provided, are bodies of rotation about a central longitudinal axis.

Alternatively, the fabrication and solid body can be of other shapes for instance of rectangular cross-section.

Conveniently the LUWPL is provided in combination with a electromagnetic wave circuit having:

an input for electromagnetic wave energy from a source thereof and an output connection thereof to the inductive coupling means of the LUWPL;

wherein the electromagnetic wave circuit is a complex impedance circuit configured as a bandpass filter and matching output impedance of the source of electromagnetic wave energy to inductive input impedance of the LUWPL.

Preferably the electromagnetic wave circuit is a tunable comb line filter; and.

The electromagnetic wave circuit can comprise:

a metallic housing, a pair of perfect electric conductors (PECs), each grounded inside the housing, a pair of connections connected to the PECs, one for input and the other for output and a respective tuning element provided in the housing opposite the distal end of each PEC.

A further tuning element can be provided in the iris between the PECs.

In accordance with a third aspect of the invention, there is provided a lamp to be driven from a source of microwave energy, the lamp comprising:

a radiator for radiating microwave energy to the bulb, a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the fabrication is of quartz and a body of alumina is provided in the waveguide space to raise the volume average of the dielectric constant of the waveguide space, the inductive coupling means being provided in the alumina body and a microwave circuit having:

an input for microwave energy from the source thereof and an output connection thereof to the radiator in the fabrication, wherein the microwave circuit is a capacitative-inductive circuit configured as a bandpass filter and matching output impedance of the source of microwave energy to input impedance of the circuit, receptacle and bulb combination; and is a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

Conveniently, the fabrication and the alumina body together fill the waveguide space.

In accordance with a fourth aspect of the invention, there is a lamp to be driven from a source of microwave energy, the lamp comprising:

a radiator for radiating microwave energy to the bulb, a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the volume average of the dielectric constant of the fabrication is less that the dielectric constant of its material and a microwave circuit having:

an input for microwave energy from the source thereof and an output connection thereof to the radiator in the fabrication, wherein the microwave circuit is a capacitative-inductive circuit configured as a bandpass filter and matching output impedance of the source of microwave energy to input impedance of the circuit, receptacle and bulb combination; and is a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

According to a fifth embodiment of the invention there is provided a lamp to be driven from a source of microwave energy, the lamp comprising:

a radiator for radiating microwave energy to the bulb, a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means including the radiator for introducing plasma exciting electromagnetic waves into the waveguide at a position at least substantially surrounded by solid dielectric material;

a body of solid dielectric material in the waveguide space, the body abutting the fabrication and having the inductive coupling means extending in it, whereby on introduction of electromagnetic waves of a determined frequency a plasma is established in the void and light is emitted via the Faraday cage and a microwave circuit having:

an input for microwave energy from the source thereof and an output connection thereof to the radiator in the fabrication, wherein the microwave circuit is a capacitative-inductive circuit configured as a bandpass filter and matching output impedance of the source of microwave energy to input impedance of the circuit, receptacle and bulb combination; and is a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

Conveniently:

the inductive coupling means extends as far as the abuttal interface between the body and the fabrication:

the fabrication and the body are of the same material:

Alternatively:

the fabrication and the body are of differing materials, the body having a higher dielectric constant.

The separate bodies where provided can be abutted against a rear face of the fabrication and be located laterally by the Faraday cage. However, preferably, the fabrication has a skirt with the separate body both abutting the rear face of the fabrication and being located laterally within the skirt.

BRIEF DESCRIPTION OF THE DRAWINGS

To help understanding of the invention, a various embodiments thereof will now be described by way of example and with reference to the accompanying drawings, in which.

DETAILED DESCRIPTION OF THE PREFERRED EMBODIMENT

Figure 1:
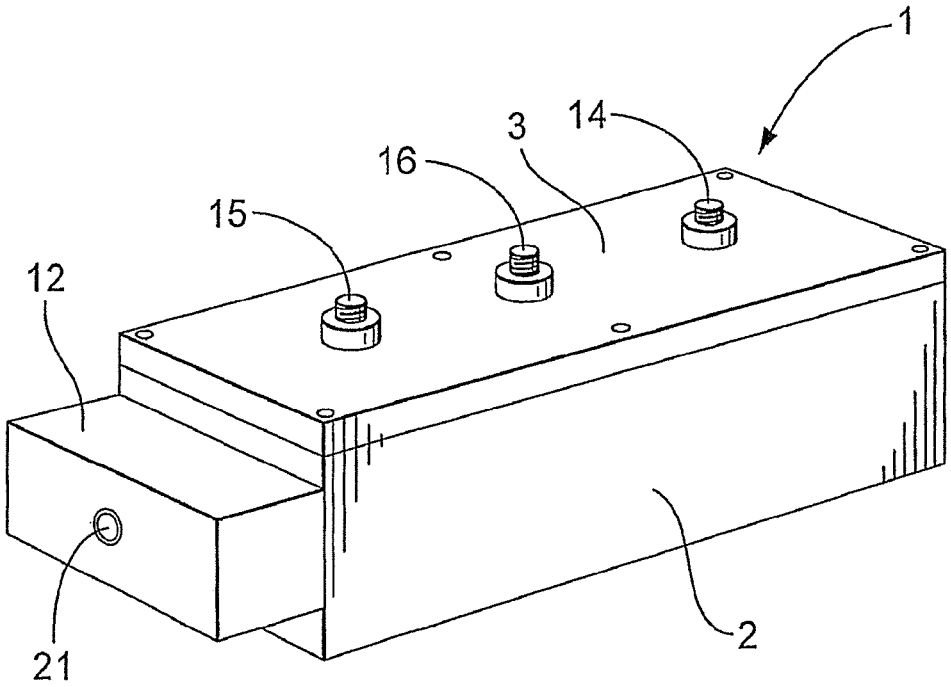
FIG. 1 is a perspective view of a lamp with a bandpass filter in accordance with the invention of the Parent application Ser. No. 12/227,750.

Referring to FIGS. 1 to 10 of the drawings, a band pass filter 1 of the invention of the patent application Ser. No. 12/227,750 is comprised of a resonant, air filled aluminium chamber 2, having a lid 3, together defining a cuboid resonant cavity 4 having a central iris 5. At opposite end nodes of the cavity, perfect electric conductors (PECs) 6,7 are provided. One is connected to a feed wire 8 from an input 9 at one end of the cavity. The other PEC is connected via a further feed 10 wire to a radiator 11 in an adjacent wave guide 12.

Threaded tuning projections 14, 15 opposite the PECs and 16 in the iris are provided, whereby the pass band and the transmission characteristics of the filter in the pass band can be tuned to match the input impedance of the band pass filter and the wave guide to the output impedance of a microwave drive circuit (not shown). Typically the impedance will be 50Ω.

The wave guide 12 is of ceramic and metallised on its outer surfaces. It is mounted on one end of the filter chamber, with an electrodeless bulb 21 in a central cavity 22 directed axially away from the chamber and the radiator in a further cavity 23 set to one side of the central cavity. This arrangement is a lamp. The arrangement is such that the filter has a pass band including the resonant frequency of the wave guide, conveniently when resonant in the half wave mode. When the filter is driven, the wave guide resonates driving the bulb.

In use, the input impedance, of the combined matching circuit and ceramic wave guide with its bulb, is such that the microwaves at the design frequency are transmitted inwards of the input with negligible reflection. Waves reflected from the ceramic wave guide are reflected back into the wave guide from the output of the matching circuit and are not transmitted through the matching circuit for propagation back towards the drive circuit.

Figure 4:
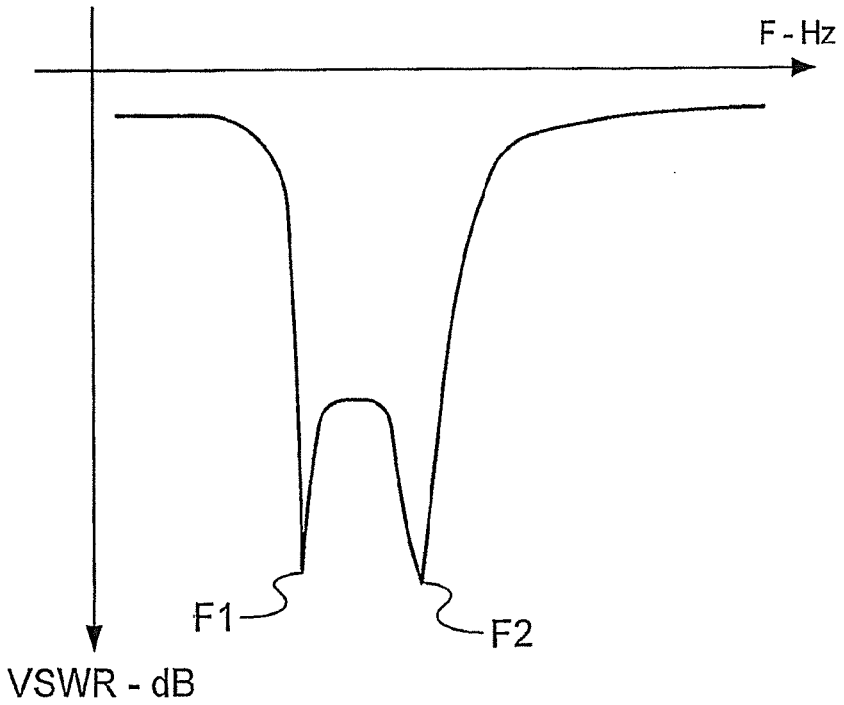
FIG. 4 is a plot of VSWR (Voltage Standing Wave Ratio) response to input frequency with varying frequency of the band pass filter alone.
Figure 2:
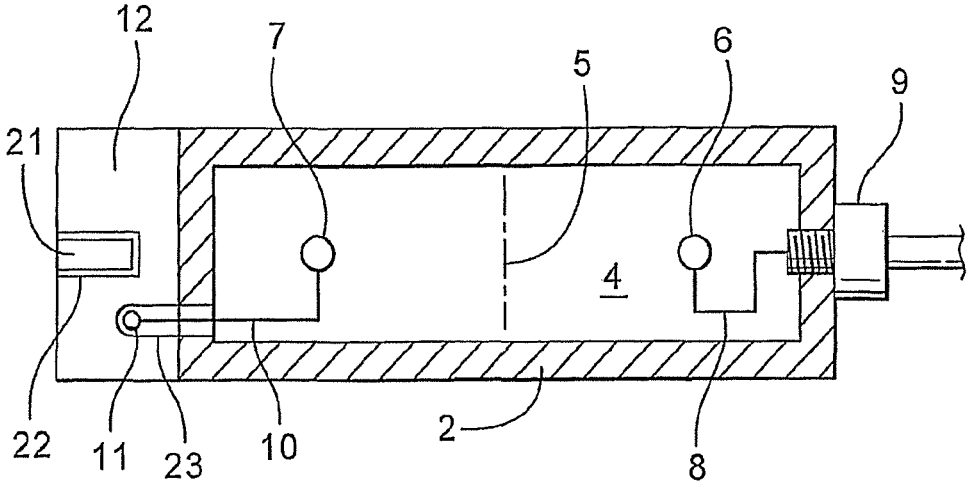
FIG. 2 is a central longitudinal cross-section in plan of the lamp of FIG. 1.
Figure 3:
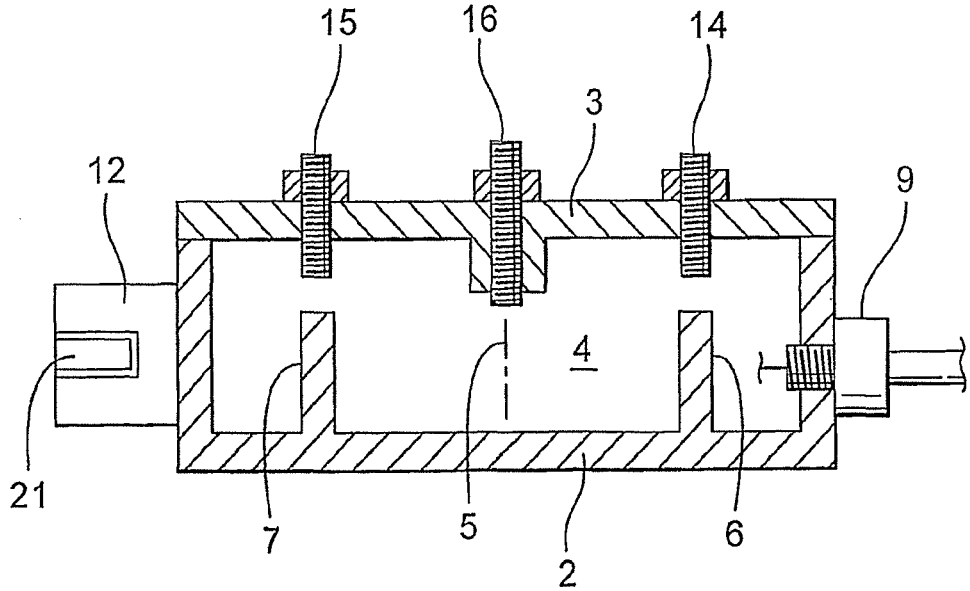
FIG. 3 is a central longitudinal cross-section in elevation of the lamp of FIG. 1.

Turning now to FIG. 4, adjustment of the band pass filter by means of the tuning projections 14,15,16 will now be described. The PECs 6,7 are similar to each other and have their tuning projections 14,15 aligned with their distal ends. Conveniently, the input PEC 6 is tuned to produce the low VSWR frequency spike F1 and the output PEC 7 is tuned to produce the high frequency spike F2. The levels and frequencies of the spikes can be controlled individually, although it will be appreciated that the adjustment of one has an effect on the other. Further, the width of the pass band is primarily controlled by the iris tuning projection 16.

Figure 5:
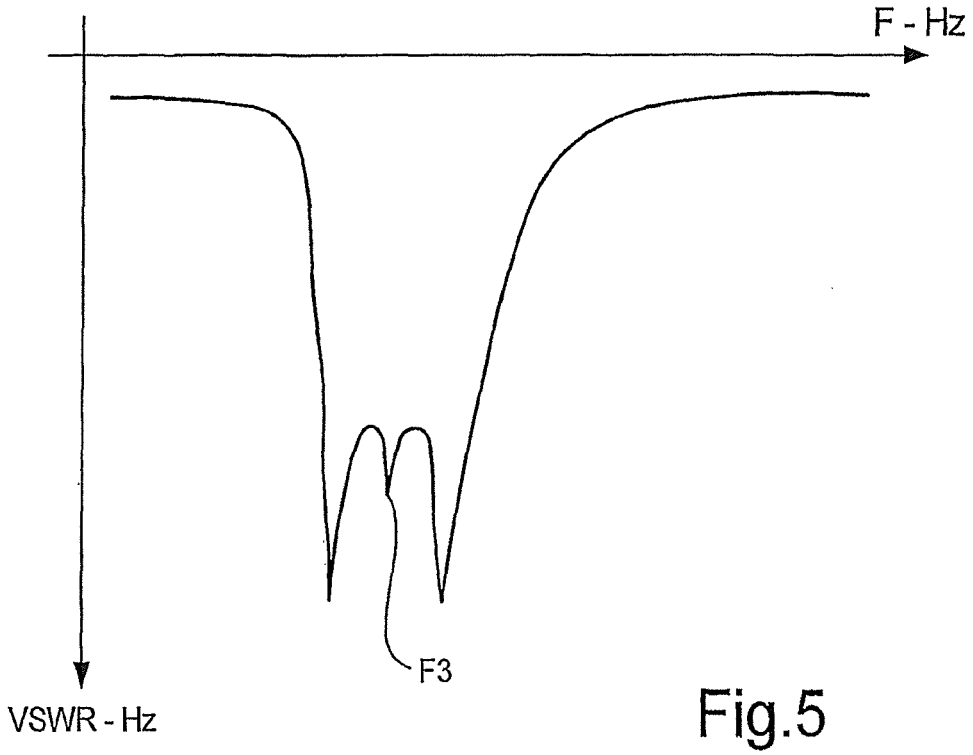
FIG. 5 is a similar plot of the combination of the band pass filter and the wave guide with its lamp prior to lighting of the bulb.
Figure 6:
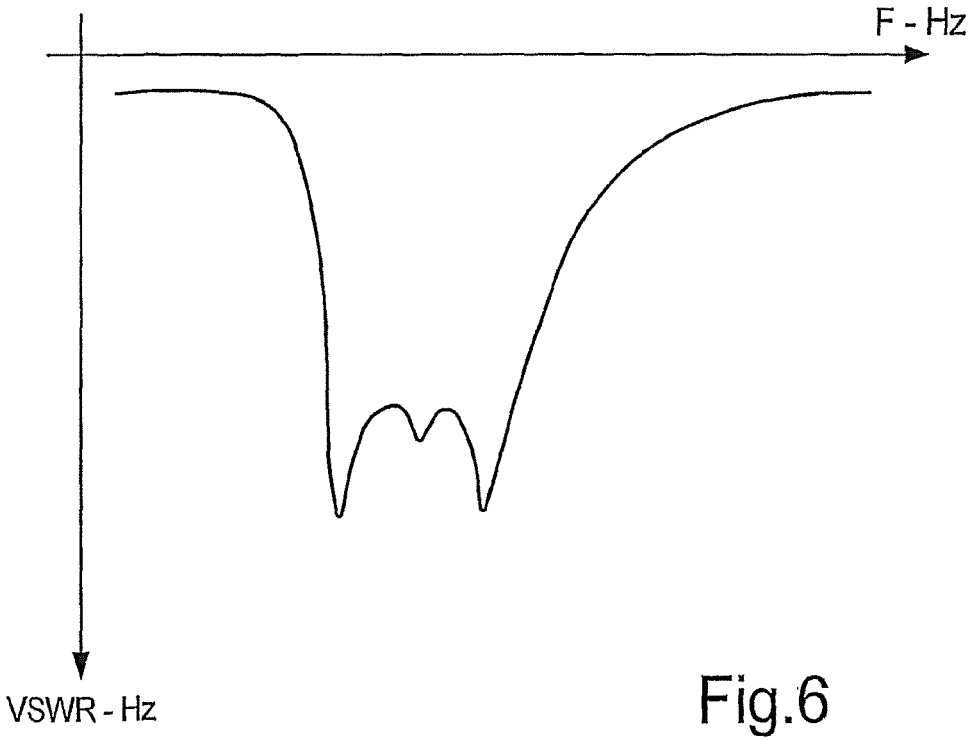
FIG. 6 is another similar plot of the combination after lighting of the bulb.
Figure 7:
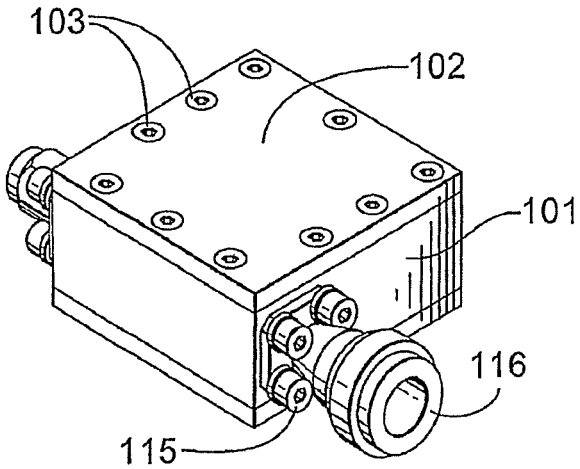
FIG. 7 is perspective view of an exemplary bandpass filter of the invention of the Parent application Ser. No. 12/227,750.
Figure 8:
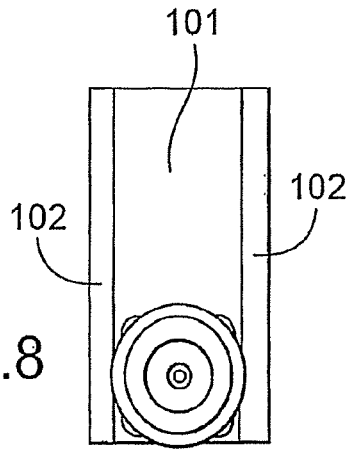
FIG. 8 is a side view of the filter of FIG. 7.
Figure 9:
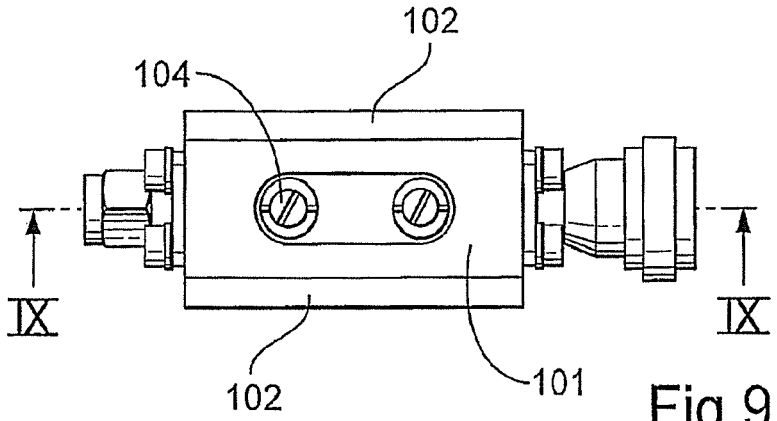
FIG. 9 is a further side view of the filter.
Figure 10:
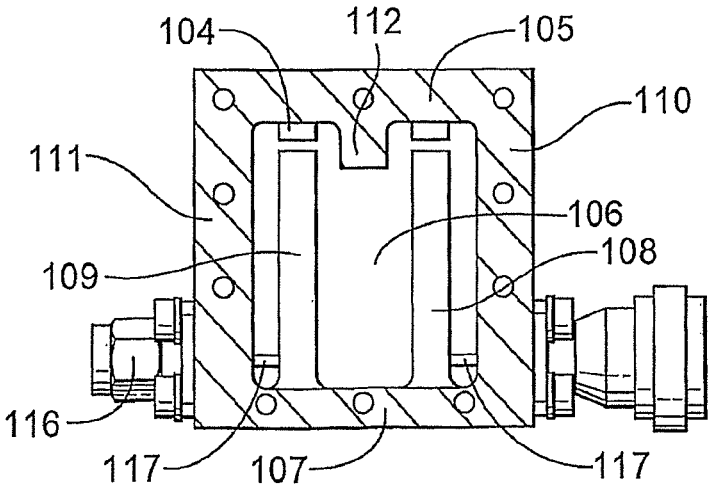
FIG. 10 is a cross-sectional side view on the line IX-IX in FIG. 9.

Whilst FIG. 4 shows the VSWR response of the filter alone, FIG. 5 shows its response when the wave guide and the bulb of the lamp are connected to it. An additional VSWR spike, having a frequency F3 between F1 and F2 is introduced. This is at the resonant frequency of the wave guide. When the lamp has been driven by microwave energy having a frequency within the pass band and with sufficient intensity to cause ionisation of the contents of the bulb, this represents a short circuit to the energy, absorbs it and emits light. The frequency at which the ionisation can be maintained is less specific and the VSWR response, as shown in FIG. 6 widens, particularly at the higher frequency end.

FIGS. 7 to 10 show a practical example of a matching circuit in accordance with the invention and suitable for driving a half wave ceramic wave guide at 2.4 GHz. It comprises a square block 101 of aluminium 39.9×39.9 mm. It has 6.0 mm thick side plates 102 screwed to it by ten screws 103 each. These are uniformly positioned, taking account of tuning screws 104 and connectors described below. The tuning screws are in one side 105 of the block, which has a wall thickness of 5.84 mm. Extending into a central cavity 106 from the opposite side 107, which is 4.24 mm thick, are two PEC fingers 108,109. These are of rectangular section. End walls 110,111 between the side walls 105,107 are 6.60 mm thick, that is in cross-section from the central cavity to the outside. All of the walls have a height—perpendicular to the 6.60 mm thickness—of 16.04 mm.

The PECs 108,109 are 5.04 mm thick in the direction of the 16.04 mm height and 4.28 mm thick in the direction of the 6.60 mm thickness of the side walls 105,107. The PEC's are positioned at mid-height of the block in the direction of the height of the side walls. Also they are equally spaced from at 3.15 mm and parallel to the side walls. Thus they have an iris gap between them of 11.84 mm. Extending into the central cavity from the opposite direction, i.e. from the tuning side wall 105 is a full height iris ear 112 centrally placed and 5.70 mm thick. It extends 5.28 mm into the cavity. From the opposite side wall, the PECs extend 26.54 mm. The block, the PECs and the iris ear are all machined from solid. All internal corners are radiused 1.5 mm.

The tuning screws are received in finely tapped bore inserts 113 aligned with the central axes of the PECs. The thread is ¼ inch by 64 threads per inch UNS, which is a very fine thread and allows fine adjustment of the characteristics of the circuit.

The end walls are tapped to receive screws 115 for input and output connectors 116. These have central wires 117 which pass direct to the PECs 3.26 mm from the inside face of the opposite side walls. The PECs are drilled 1.3 mm to receive wires 117. These are soldered in position.

The invention of the Parent is not intended to be restricted to the details of the above described embodiment. For instance, the skin inside of the aluminium block and the side plates can be plated with very high conductivity metal such as silver or gold. A 2.4 GHz, the skin depth is 2 microns. Plating to 6 or 10 microns provides amply sufficient plating for the currents induced to be in the high conductivity plating.

Figure 11:
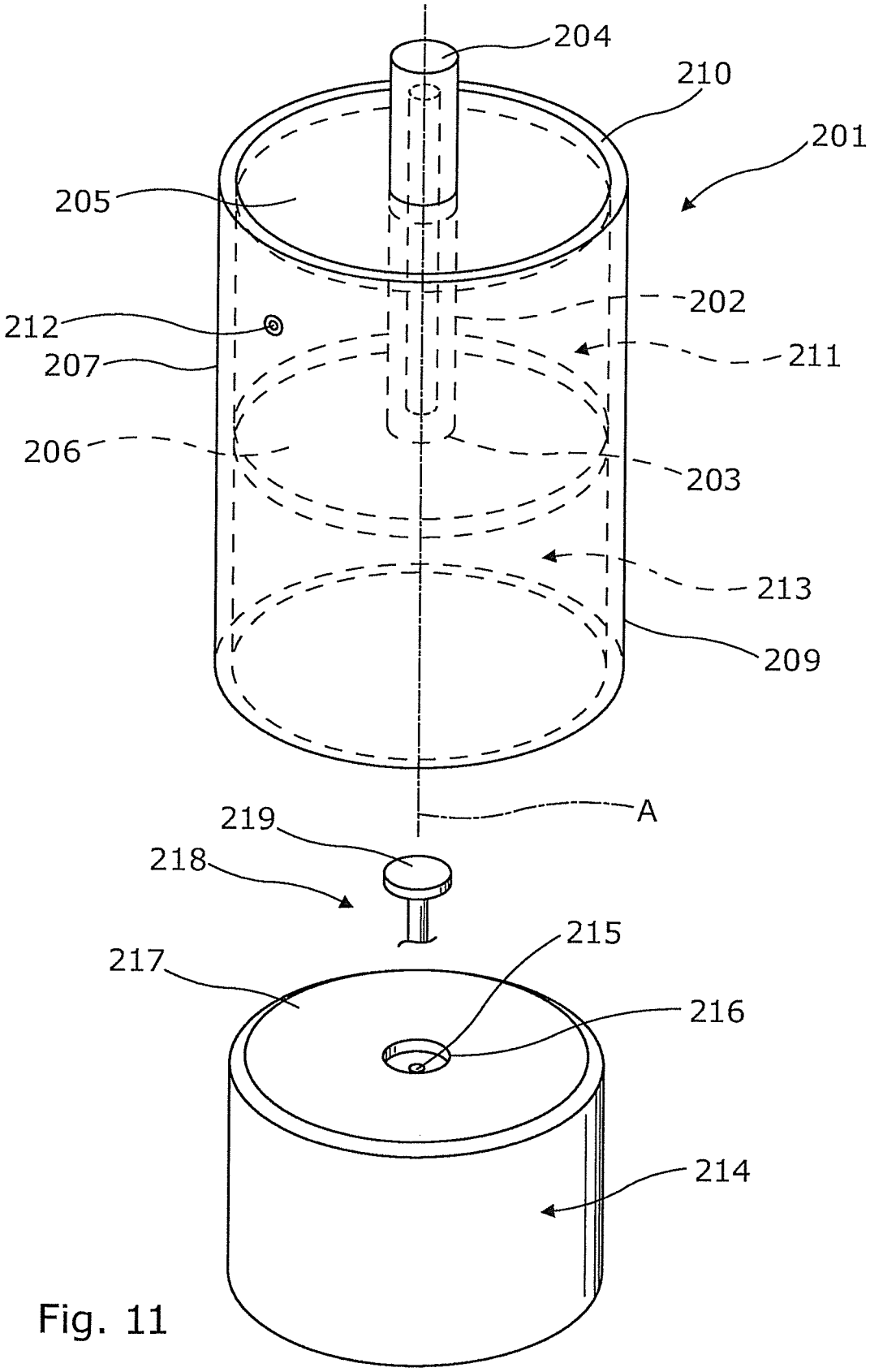
FIG. 11 is an exploded view of a quartz fabrication, an alumina block and an aerial of an LUWPL in accordance with the present Continuation in Part.
Figure 12:
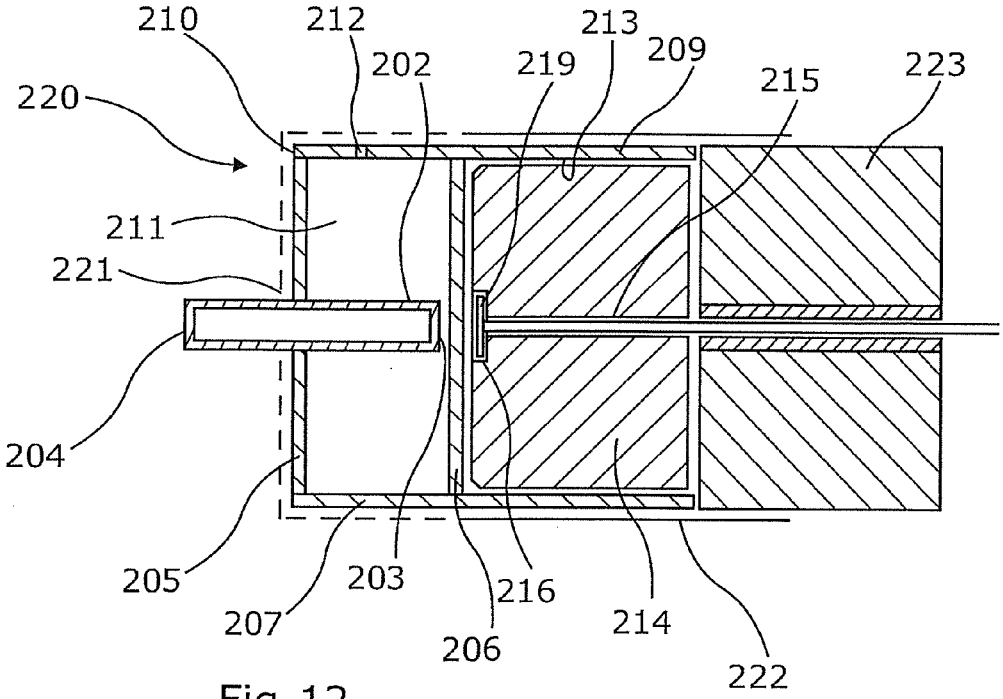
FIG. 12 is a central, cross-sectional side view of the LUWPL of FIG. 11.
Figure 13:
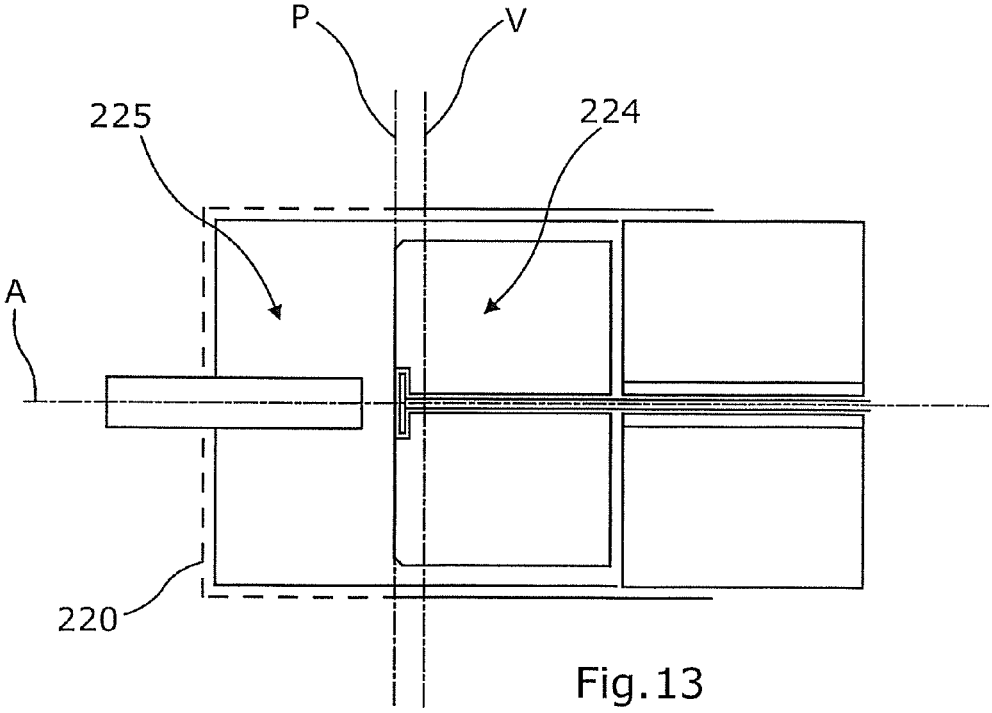
FIG. 13 is a diagrammatic view similar to FIG. 12 of the LWMPLS.
Figure 14:
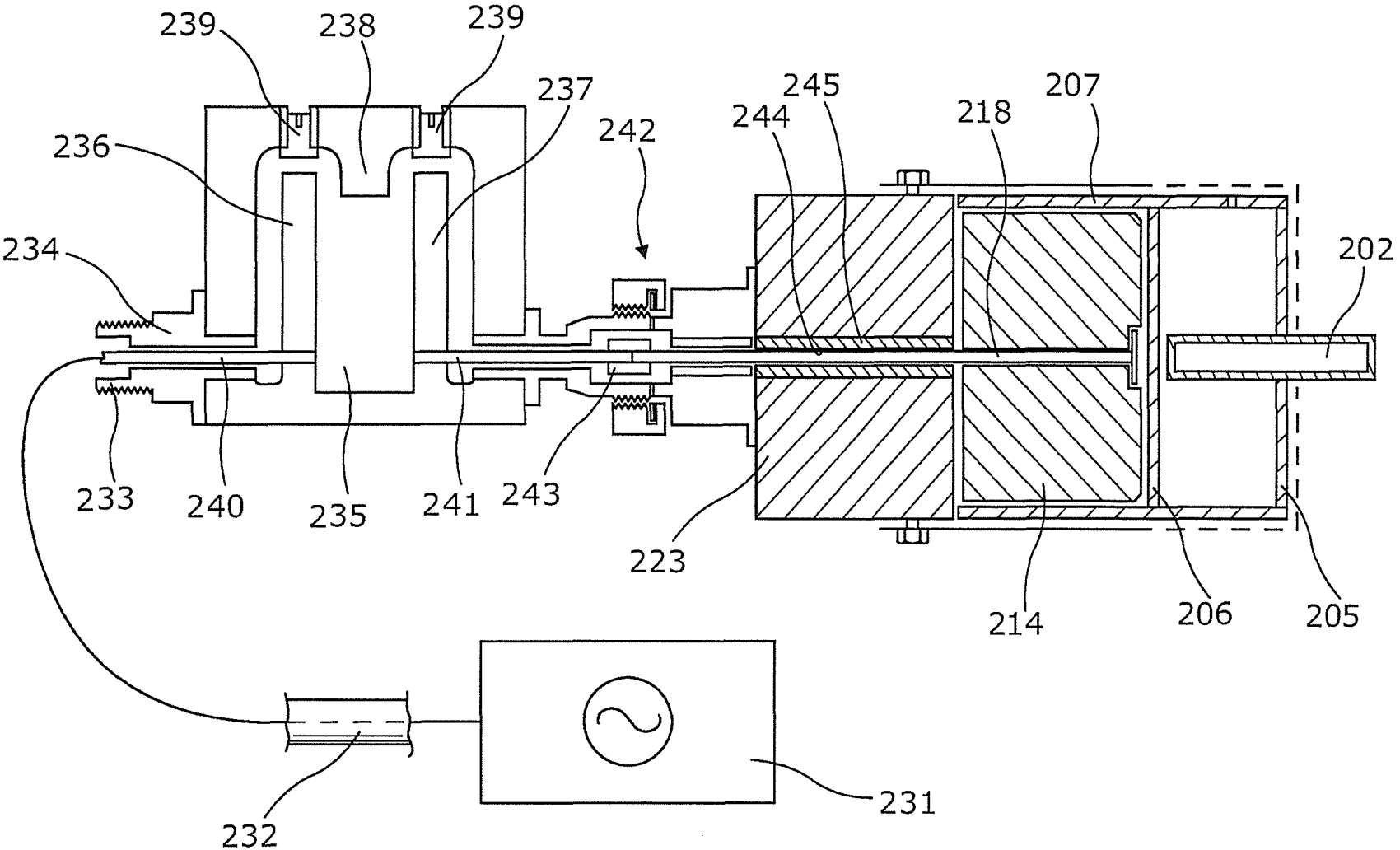
FIG. 14 is a cross-sectional view of the LUWPL of FIG. 11, together with a matching circuit for conducting microwaves to the LUWPL, as arranged for prototype testing.

Referring to FIGS. 11 to 13 of the drawings, the Lucent Waveguide Electromagnetic Wave Plasma Light Source thereshown and used in the embodiment of the Continuation in Part shown in FIG. 14 is a prototype structure. It has been tested and found to operate. Indeed it is expected that the production version will be similar to that shown in the drawings and described below. It has a fabrication 201 of quartz, that is to say fused as opposed to crystalline silica sheet and drawn tube. An inner closed void enclosure 202 is formed of 8 mm outside diameter, 4 mm inside diameter drawn tube. It is sealed at its inner end 203 and its outer end 204. The methods of sealing known from our International Patent Applications Nos WO 2006/070190 and WO2010/094938 are suitable. Microwave excitable plasma material is sealed inside the enclosure. Its outer end 204 protrudes through an end plate 205 by approximately 10.5 mm and the overall length of the enclosure is approximately 20.5 mm.

The end plate 205 is circular and has the enclosure 202 sealed in a central bore in it, the bore not being numbered as such. The plate is 2 mm thick. A similar plate 206 is positioned to leave a 10 mm separation between them with a small approximately 2 mm gap between the inner end of the enclosure and the inner plate 206. The plates are 34 mm in diameter and sealed in a drawn quartz tube 207, the tube having a 38 mm outside diameter and 2 mm wall thickness. The arrangement places the two tubes concentric with the two plates extending at right angles to their central axis. The concentric axis A and is the central axis of the waveguide as defined below.

The outer end 210 of the outer tube 207 is flush with the outside surface of the outer plate 205 and the inner end of the tube extends 17.5 mm back from the back surface of the inner plate 206 as a skirt 209. This structure provides:

an annular cavity 211 between the plates, around the void enclosure and within outer tube. The outer tube has a sealed point 212, through which the cavity is evacuated and refilled with low pressure nitrogen having a pressure of the order of one tenth of an atmosphere;

a skirted recess 213.

Accommodated in the skirted recess is a right-circular-cylindrical block 214 of alumina dimensioned to fit the recess with a sliding fit. Its outside diameter is 33.9 mm and it is 17.7 mm thick. It has a central bore 215 of 2 mm diameter and a counter-bore 216 of 6 mm diameter and 0.5 mm depth in its outer face 217 abutting the back face of the inner plate 206. The rim of the outer face is chamfered against sealing splatter preventing the abuttal being close. An antenna 218 with a Tee/button head 219 is housed in the bore 215 and counter-bore 216.

The quartz fabrication 201 is accommodated in hexagonal perforated Faraday cage 220. This extends across the fabrication at the end plate 205 and back along the outer tube for the extent of the cavity 210. The cage has a central aperture 221 for the outer end of the void enclosure and an imperforate skirt 222 extending 8 mm further back than the quartz skirt 209, which accommodates the alumina block 214. An aluminium chassis block 223 carries the fabrication and the alumina body, with the imperforate cage skirt partially overlapping the aluminium block. Thus, the Faraday cage holds these two components together and against the block 223. Not only does the block provide mechanical support, but also electro-magnetic closure of the Faraday cage.

The above dimensions provide for the Faraday cage to be resonant at 2.45 GHz.

The waveguide space being the volume within the Faraday cage is notionally divided into two regions divided by the plane P at which the alumina block 214 abuts the inner plate 206 of the fabrication. The first inner region 224 contains the antenna, but this has negligible effect on the volume average of the dielectric constant of the material in the region. Within the region are the alumina block and the quartz skirt. These contribute to the volume averages as follows:

Alumina block 214: Volume=$\pi\times(33.9/2)^2\times 17.7=15967.7$,

Dielectric constant=9.6,

Volume×Dielectric constant=153289.9.

Quartz Skirt 209 Volume=$\pi\times((38/2)^2-(34/2)^2)\times 18=4069.4$,

Dielectric constant=3.75,

Volume×D. constant=15260.3.

First Region 224 Volume=$\pi\times((38/2)^2)\times 18=20403.7$

Volume average dielectric constant=(153289.9+15260.3)/20403.7=8.26.

The second region 225 comprises the fabrication less the skirt. Its part contribute to the volume averages as follows:

Void Enclosure Volume=$\pi\times((8/2)^2-(4/2)^2)\times 8=301.4$,

Dielectric constant=3.75,

Volume×D. constant=1130.3.

Cavity Enclosure Volume=$\pi\times((38/2)^2-(34/2)^2)\times 10=2260.8$,

Dielectric constant=3.75,

Volume×D. constant=8478.1.

Outer Plate Volume=$\pi\times((38/2)^2)\times 2=2267.1$,

Dielectric constant=3.75,

Volume×D. constant=8501.6.

Inner Plate Volume=$\pi\times((38/2)^2)\times 2=2267.1$,

Dielectric constant=3.75,

Volume×D. constant=8501.6.

Cavity Volume=Entire volume less sum of quartz parts=15869.5−301.4−2260.8−2267.1−2267.1=8773.1, Dielectric constant=1.00, Volume×D. constant=8773.1.

Second Region 225 Volume=$\pi\times((38/2)^2)\times 14=15869.5$

Volume average dielectric constant=(1130.3+8478.1+8501.6+8501.6+8773.1)/15869.5=2.23.

Second Region 25 Volume=$\pi\times((38/2)^2)\times 14=15869.5$

Volume average dielectric constant=(1130.3+8478.1+8501.6+8501.6+8773.1)/15869.5=2.23.

It can thus be seen the volume averaged dielectric constant of the first region is markedly higher than that of the second region. This is due to the high dielectric constant of the alumina block. In turn the result of this is that the first region has a predominant effect on the resonant frequency of combination of parts contained within the wave guide.

The contrasting average values for the two regions, 8.26 and 2.23, can be usefully contrasted with the average for the entire waveguide space of (20403.7×8.26)+(15869.5×2.23)/(20403.7+15869.5)=5.62.

If the comparison of regions is not done of the basis of the first and second regions being divided by the abuttal plane between the fabrication and the alumina block, but between the two equal semi-volumes the comparison has an essentially similar result. The division plane V, parallel to the abutment plane, falls 1.85 mm into the alumina block. The latter is uniform in the direction of the axis A. Therefore the volume average of the first, rear semi-volume 226 remains 8.26. The second, other, front semi-volume 227 has a contribution from the slice of alumina and quartz skirt. This contribution can be calculated from its volume average dielectric constant:

$$1.85 \text{ mm slice Volume}=\pi\times(38/2)^2\times1.85=301.4,$$

$$\text{Dielectric constant}=8.26,$$

$$\text{Volume}\times\text{D. constant}=2097.0.$$

$$\text{Front Semi-Volume Volume}=\pi\times((38/2)^2)\times14+\pi\times(38/2)^2\times1.85=15869.5+301.4=16170.9$$

$$\text{Volume average dielectric constant}=(15869.5\times2.23+2097.0)/16170.9=2.32.$$

Thus for this particular embodiment, using quartz, alumina, 2 mm wall thickness and an operating frequency of 2.45 GHz, the difference in ratio between:

Front/Rear Regions at 2.23:8.26 as against

Front/Rear Semi-Volumes 2.32:8.26.

This is a Ratio of 0.270:0.280 or 0.96:1.00.

Thus it can be said that the two ratios are alternative comparisons which are both determinative of the same inventive concept.

It will be noted that this LUWPL is appreciably smaller than an LER quartz crucible operating at 2.45 GHz, eg 49 mm in diameter by 19.7 mm long.

Turning now to FIG. 14, and bearing in mind that the prototype structure of FIGS. 11 to 13 is dimensioned to operated at 2.45 GHz, FIG. 14 shows a combination of the LUWPL structure and a bandpass filter for matching generated microwaves to the LUWPL. In production at this frequency, these would be generated by a magnetron. In prototype testing, they were generated by a bench oscillator 231 and fed by coaxial cable 232 to the input connector 233 of a band pass filter 234. This is embodied as an air waveguide 235 having two perfect electric conductors (PECs) 236,237 arranged for input and output of microwaves. A third PEC 238 is provided in the iris between the two. Tuning screws 239 are provided opposite the distal ends of the PECs. The input PEC is connected by a wire 240 to the core of the coax cable 232. The output is connected to another wire 241, which is connected through to the antenna 218 via a pair of connectors 242, central to which is a junction sleeve 243. Intermediate the filter 234 and the LUWPL, the aluminium chassis block 223 is provided. It has a bore 244 through which the wire 241 extends, with the interposition of a ceramic insulating sleeve 245.

It should be noted that the arrangement described may not start spontaneously. In prototype operation, the plasma can be initiated by excitation with a Tesla coil device. Alternatively, the noble gas in the void can be radio-active such as Krypton 85. Again, it is anticipated that the plasma discharge can be initiated by apply a discharge of the automotive ignition type to an electrode positioned close to the end 204 of the void enclosure.

The resonant frequency of the fabrication and alumina block system changes marginally between start up when the plasma is only just establishing and full power when the plasma is full established and acts as a conductor within the plasma void. It is to accommodate this that a bandpass filter, such as described, is used between the microwave generator and the LUWPL.

Figure 15:
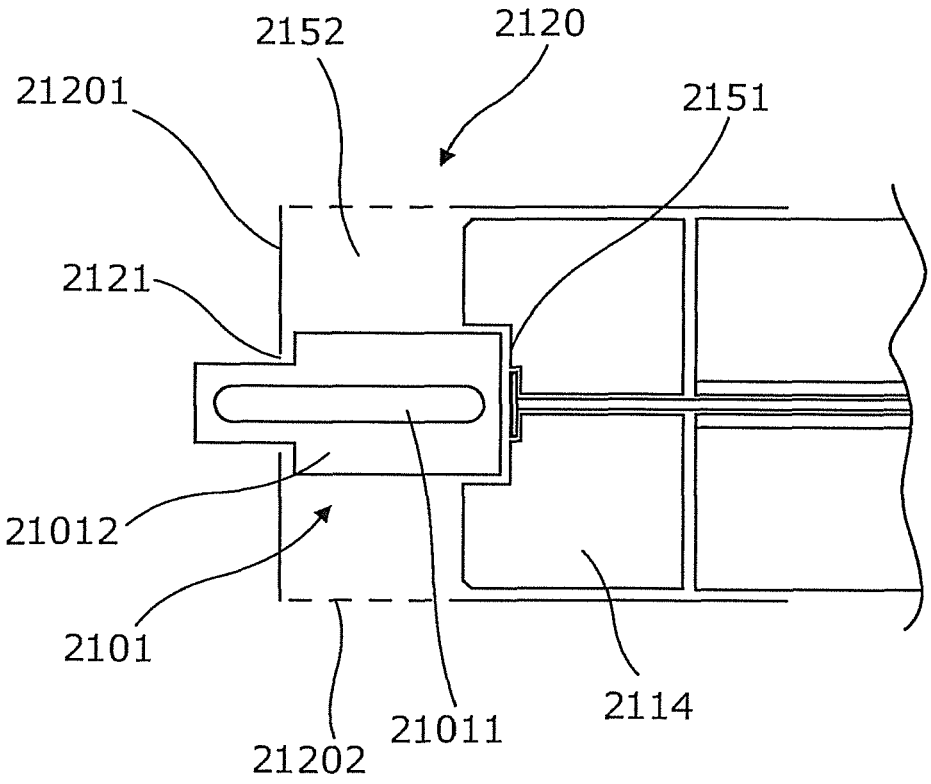
FIG. 15 is a view similar to FIG. 13 of a modified LUWPL.

Turning now to FIG. 15, there is shown a modified LUWPL in which the fabrication 2101 has a smaller over all diameter than the alumina block 2114 and the Faraday cage 2120. The front face of the alumina block has a shallow recess 2151 sized to receive and locate the back of the fabrication. The front of the fabrication is located in an aperture 2121 in the front of the Faraday cage. This can have a metallic disc 21201 extending laterally to perforated cylindrical portion 21202, through which light can radiate from a plasma in a void 21011 in the fabrication. The arrangement leaves an annular air gap 2152 around the fabrication and within the Faraday cage, which contributes to the low volume average dielectric constant of the fabrication region. Whilst an annular cavity such as the cavity could be provided, it would be narrow and it is preferable for the fabrication to be formed with a solid wall 21012 around the void 21011. This variant has the advantage of simpler forming of the fabrication, but is not expected to have such good coupling of microwave energy from the antenna to the plasma. Further light propagating axially of the fabrication will not be able to radiate in this direct through the Faraday cage, being reflected by the disc 21201. However this is not necessarily a disadvantage in that most of the light radiates radially from the fabrication and will collected for collimation by a reflector (not shown) outside the LUWPL.

Figure 16:
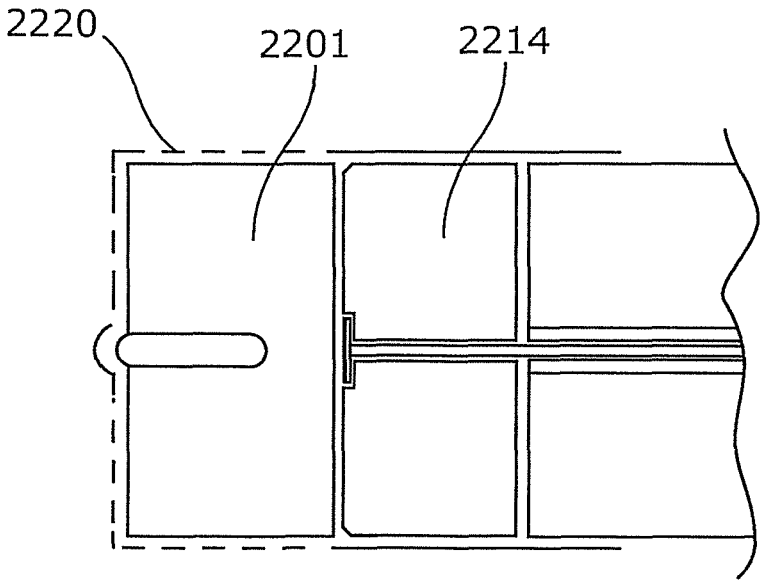
FIG. 16 is a similar view of another modified LUWPL.

Turning to another modified LUWPL as shown in FIG. 16, the fabrication 2201 is the same diameter as the alumina block 2214 and the Faraday cage 2220. However it is of solid quartz. This has a less marked difference of volume average dielectric constant between the regions defined by the fabrication and the block, being the difference between the dielectric constants of their respective materials.

Figure 17:
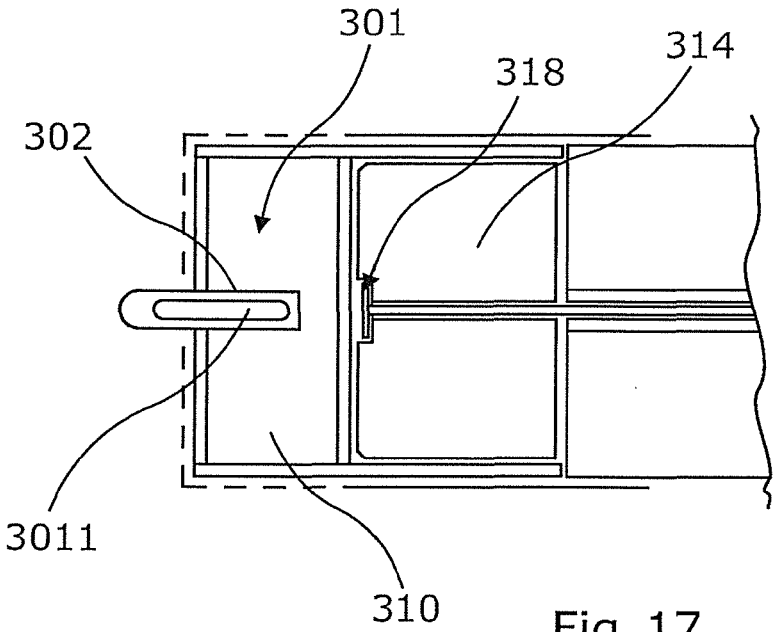
FIG. 17 is a similar view of a third modified LUWPL.

In the modified LUWPL of FIG. 17, the fabrication 301 is effectively identical to that 1 of the first embodiment. The difference is in the solid dielectric block being a quartz block 314. As shown the quartz block is separate from the fabrication. However it could be part of the fabrication. This arrangement would provide fewer interfaces between the antenna 318 and the void 3011. This is believed to be of advantage in enhancing the coupling from the antenna to the void. The dielectric constant volume average difference between the fabrication and the block or at least the solid piece of quartz in which the antenna extends is less, relying on the presence of the annular cavity 310 around the void enclosure 302.

Figure 18:
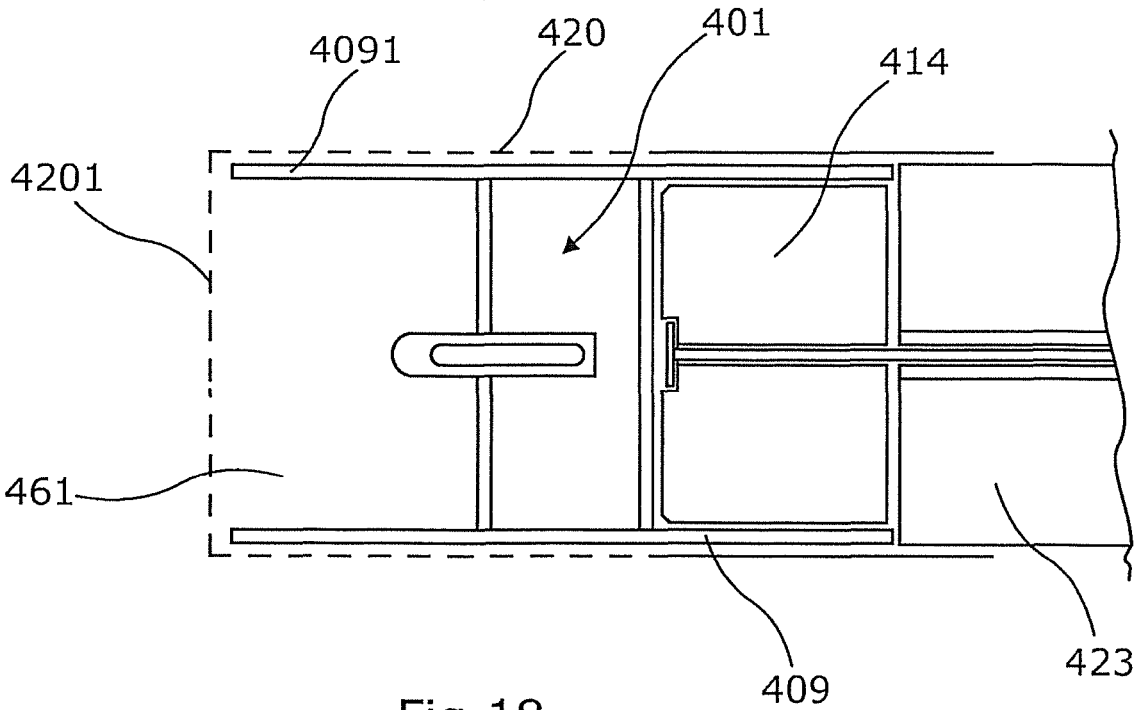
FIG. 18 is a similar view of a fourth modified LUWPL.

In another modification, as shown in FIG. 18, the fabrication 401 has a forward extending skit 4091 in addition to the skirt 409 around the alumina block 414. With a portion 461 of the waveguide space enclosed within the Faraday cage 420 being empty and thus enhancing the dielectric constant volume average difference. The skirt 4091 supports the Faraday cage and enables the latter at it is front disc 4201, which can be perforate or not, to retain the fabrication and the block against the chassis block 423.

Figure 19:
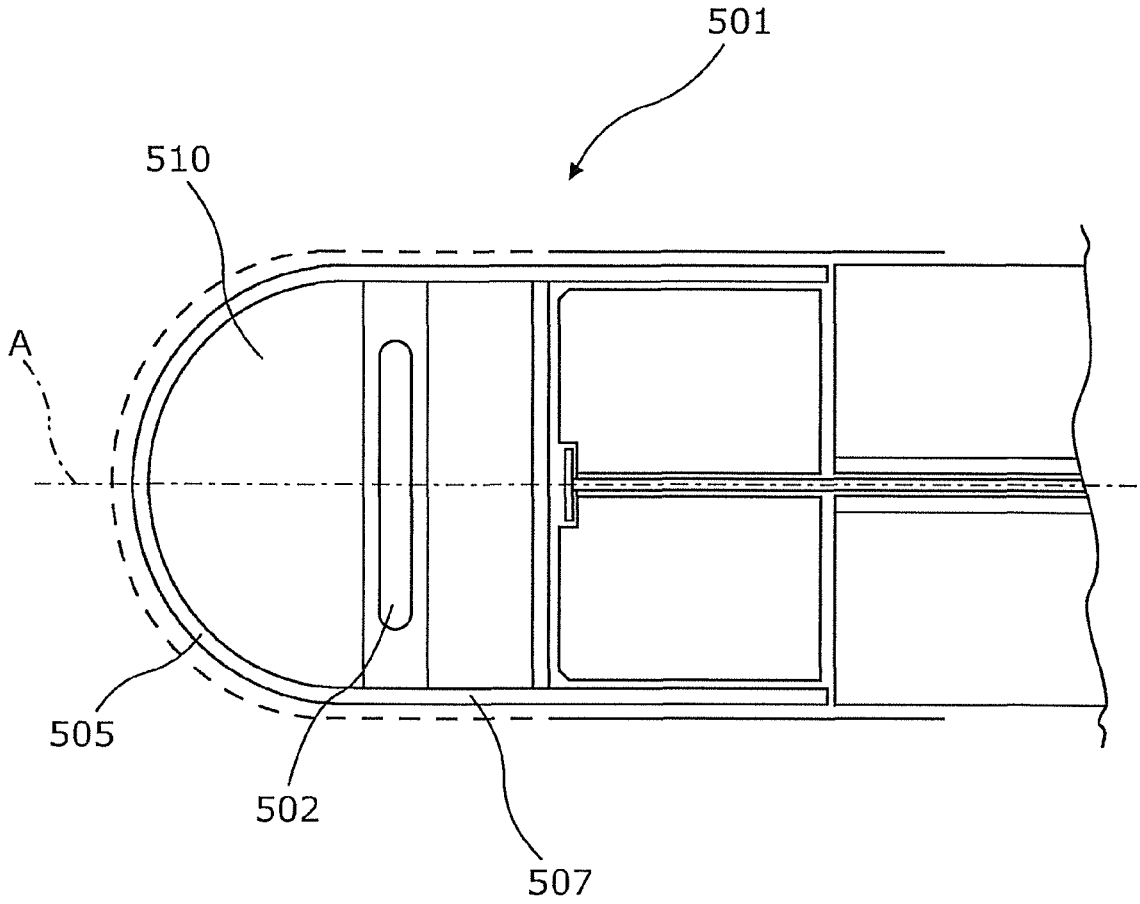
FIG. 19 is a similar view of a fifth modified LUWPL.

In yet another modification, shown in FIG. 19, the fabrication 501 is essentially similar to that of FIGS. 11 & 12 except for two features. Firstly the plasma void enclosure 502 is oriented transversely with respect to the longitudinal axis A of the waveguide space. The enclosure is sealed into opposite sides of the 507 of the cavity 510 of the surrounding the enclosure. Further the front plate is replaced by a dome 505.

Figure 20:
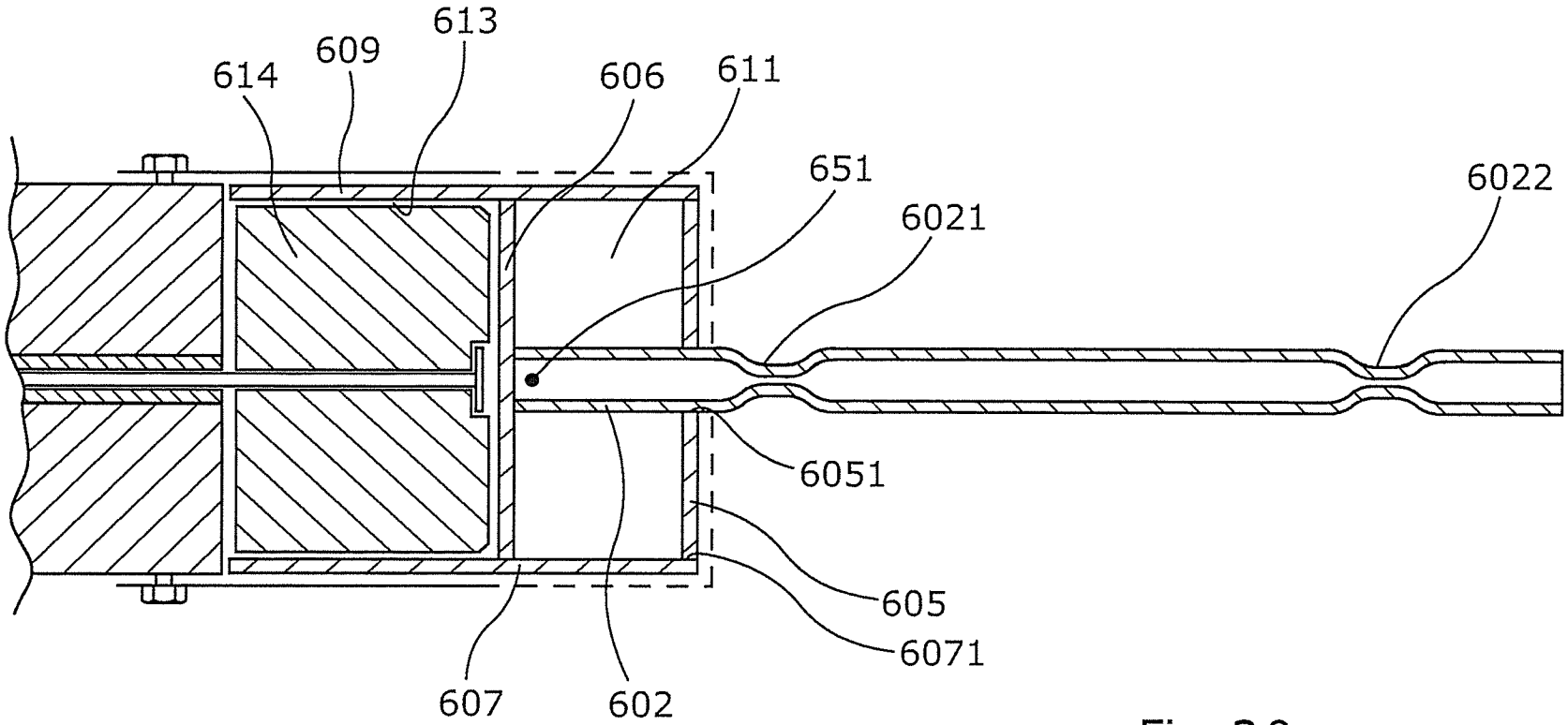
FIG. 20 is a similar view of a sixth modified LUWPL.

Turning to FIG. 20, the LUWPL there shown has a slightly different fabrication to that of FIGS. 11 to 14. It will be described with reference to its method of fabrication:

1. To a disc 606 of quartz, a small diameter tube 602 of quartz is sealed centrally. The tube has a near neck 6021 and a far neck 6022;
2. A length 607 of large diameter tube is sealed to the disc 606, in a manner to provide for a cavity 611 and a recess 613 for an alumina block 614 within a skirt 609;
3. A further, front disc 605 of quartz with a central bore 6051 is sealed to the rim 6071 of the large diameter tube and to the smaller diameter tube, with the near neck just outside the front disc;
4. A pellet 651 of microwave excitable material is dropped into the inner tube, which is evacuated, back-filled with noble gas and sealed at the outer neck;
5. The inner tube is then sealed at the inner neck.

Normally the components that are sealed to form the fabrications will be of quartz which is transparent to a wide spectrum of light. However, where it is desired to restrict the emission of certain coloured light and/or certain invisible light such as ultra-violet light, quartz which is opaque to such light can be used for the outer components of the fabrication or indeed for the whole fabrication. Again, other parts of the fabrication, apart from the void enclosure can be made of less expensive glass material.

Figure 21:
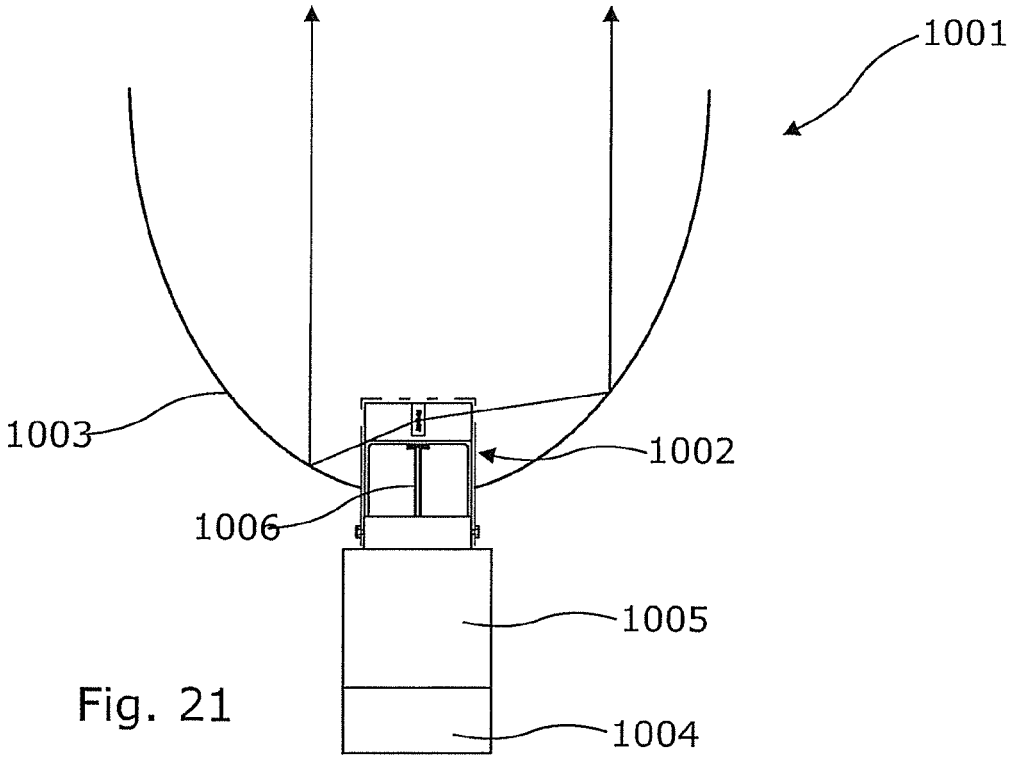
FIG. 21 is a diagrammatic side view of a light emitter of the invention in a lamp, together with Faraday cage, a magnetron, a matching circuit and an antenna as described in the priority application No GB1021811.3.
Figure 22:
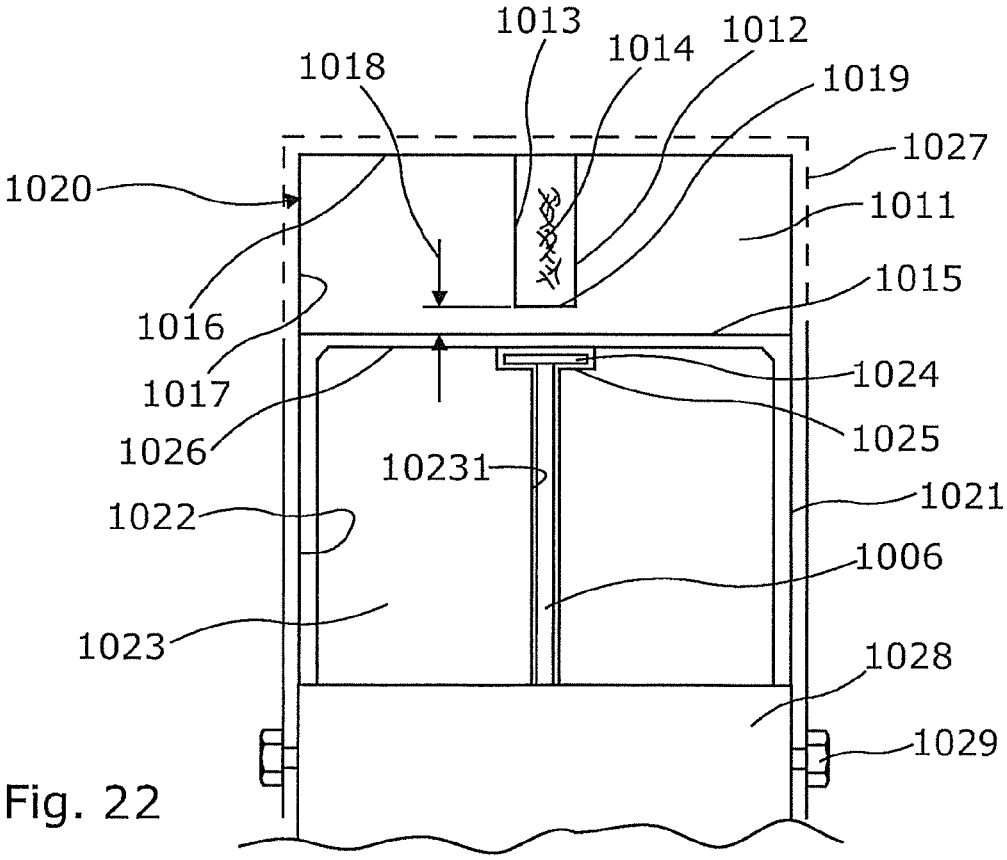
FIG. 22 is a diagrammatic view on a larger scale of light emitter of FIG. 20.

The embodiment described above with reference to FIGS. 11 to 14 is of the prototype as tested, which represents the best manner of which we are aware for working the invention. For the avoidance of doubt, the description of British Patent Application No GB1021811.3, the priority application, is now repeated verbatim below, with reference to FIGS. 21 to 24 and addition of 1000 to the reference numerals:

Referring first to FIGS. 21 & 22 of the drawings, a lamp 1001 has a light emitter 1002 at the focus of a reflector 1003. A magnetron 1004 provides microwaves to a matching circuit 1005, from which the microwaves propagate along an antenna 1006 for exciting the light emitter.

The emitter as such has a central cavity 1011 in which is arranged a bulb 1012 having a void 1013 containing a microwave excitable material 1014. Typically the bulb is of transparent quartz. The cavity is surrounded by plane back and front walls 1015, 1016 and a circular cylindrical side wall 1017. The walls are sealed together, whereby the central cavity is sealed—typically with a vacuum maintained in it. In the embodiment shown, the bulb is integral with the front wall 1016 and extends towards the back wall with an insulating gap 1018 established at the distal/back end 1019 of the bulb.

The back, front and side walls define an enclosure 1020 for the cavity and are also formed of transparent quartz, whereby not only do they maintain the sealed nature of the cavity 1011, but they allow emission of light from the bulb, as explained in more detail below.

The cylindrical side wall extends back from the rear wall as a skirt 1021, defining with the back wall a recess 1022. In the recess is received—with a conventional engineering sliding as opposed to interference fit—a circular cylindrical, opaque body 1023 of alumina, which is a material of higher dielectric constant than quartz, typically 9.6 to 3.75. Centrally this has an antenna bore 10231 in which the antenna 1006 extends. The latter has a button head 1024, accommodated in a complementary recess 1025 in a front face 1026 of the body, the face being in abutment with the back wall 1015 of the enclosure. This arrangement places the high electric field present at the button in close proximity with the bulb and the excitable material in it.

A Faraday cage 1027 surrounds the enclosure, including the skirt 1021, extending back as far as a grounded, aluminium boss 1028 on which the light emitter is mounted, being held onto the boss by means of the cage and screws 1029 holding the cage to the boss. Thus the cage is grounded. The cage is reticular, that is netlike with apertures, in region of the cavity 1011 and plain further back to the boss 1028.

In use, microwaves are applied to the antenna and radiated into the enclosure from the antenna's button head 1024. Not only do they propagate to the bulb, but the enclosure together with the body, taking account of the dielectric constants of their materials, form a resonant system within the Faraday cage, as a result of which the microwaves propagated from the antenna build up a resonant electric field in the light emitter. The resultant electric field at the void in the bulb is much greater than it would be in the absence of the components being dimensioned for resonance. The field establishes a plasma in the excitable material in the void and light emitted therefrom radiates through the front and side walls. Nothing, except the bulb, extends into the cavity whereby no shadow is cast—as might be if the antenna extended into the cavity—except for any shadow from the Faraday cage. However its mesh is so small as not to cast a perceptible shadow.

Figure 23:
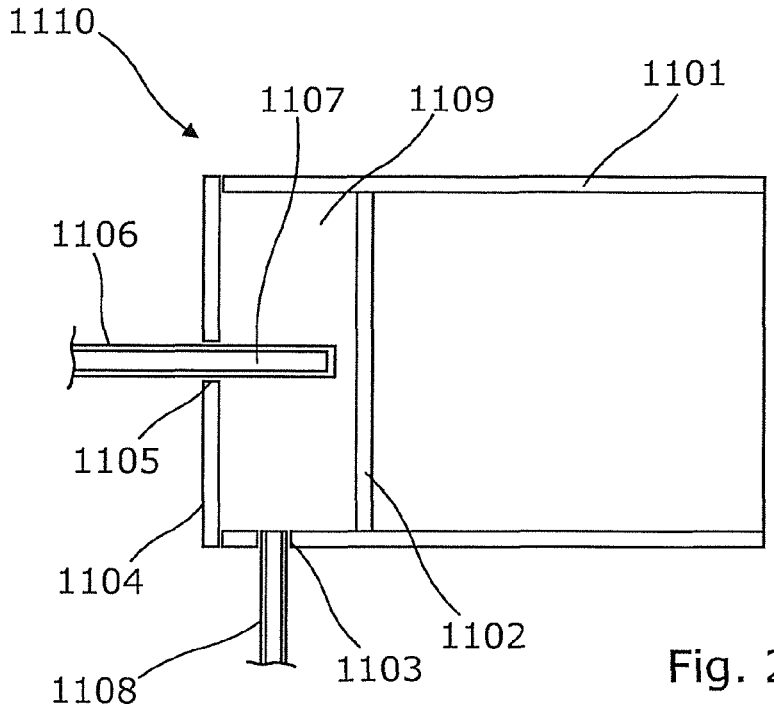
FIG. 23 is a side view on a larger scale again of components of the enclosure of the light emitter of FIG. 21.
Figure 24:
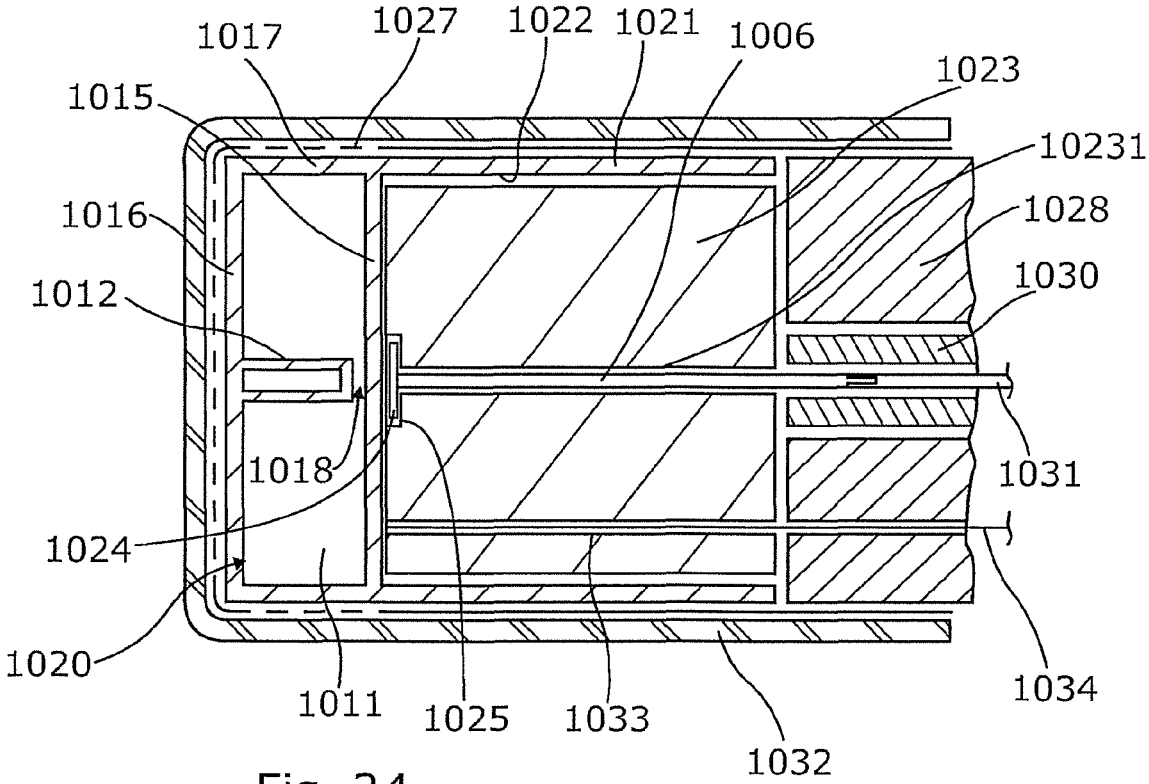
FIG. 24 is a cross-sectional side view of the enclosure of FIG. 22 assembled with a body of dielectric material, a button head antenna, a Faraday cage and UV screen.

Turning now to FIGS. 23 & 24, the enclosure is made as follows:

1. A length 1101 of quartz tube for the side wall and skirt is cut together with a flat, circular disc 1102 for the back wall. These are mounted in a glass lathe on mandrels with the disc perpendicular to the axis of the tube. The disc is fused into position.
2. A bore 1103 is made in the tube at the position of the enclosure.
3. A second quartz disc 1104 is cut for the front wall, being slightly larger than the first to abut the end of the length 1101. A central bore 1105 is drilled in it. A piece of small-diameter, closed-off, quartz tube 1106 is inserted in the bore 1105 and fused into position.
4. The tube 1106 is evacuated, filled with the excitable fill and sealed close to the surface of the disc 1104 to form a bulb 1107.
5. The disc 1104 is offered up to the end of the tube 1101 and fused to it.
6. A second piece 1108 of small diameter quartz tube is sealed into the bore 1103. The cavity 1109 in the enclosure 1110 formed is evacuated and the tube 1108 is "tipped off" at the bore 1103.

For operation at 2.45 GHz, the tube 1101 is 28.7 mm long and has a 38 mm outside diameter and 2 mm wall thickness. The discs are of 2 mm plate, the disc 1102 being a sliding fit in the tube 1101 and the disc 1104 being of 38 mm diameter. The disc 1102 is fused 9 mm from the open end of the tube 1101. The bulb forming tube is set to extend 8 mm from the disc 1104, giving an assembled clearance of 1 mm from the plate 1102. This tube is 6 mm in diameter with a 1.5 mm wall thickness.

Thus are formed the:
central cavity 1011
bulb 1012
void 1013
back and front walls 1015, 1016
circular cylindrical side wall 1017
insulating gap 1018
enclosure 1020
skirt 1021
recess 1022.

With the resultant dimensions and the alumina body 1023 completely filling the recess 1022 within the skirt 1021 and the Faraday cage 1027 closely surrounding the emitter, resonance at 2.45 GHz is possible.

The dimensions of the antenna and its button head 1024 are important for maximum energy transfer into the resonant system. The aerial is of brass and 2 mm in diameter, with the button being 6 mm in diameter and 0.5 mm in thickness. The aerial extends into the boss 1028, where within an insulating sleeve 1030 of alumina, it is threaded into a connection 1031 from the matching circuit 1005, Surrounding the enclosure 1020 and the skirt 1021, outside the Faraday cage 1027 extends a borosilicate glass cover 1032. This provides physical protection for the cage and the quartz enclosure and skirt. Also it filters and protects against any small amount of UV emission from the plasma—the Faraday cage protecting against microwave emission. A final detail of note is a bore 1033 through the alumina body 1023 for an optic fibre 1034 for detecting establishment of the plasma, where the microwave power for continued light emission can be controlled.

As can be appreciated from FIG. 21, the light emitter 1002 has advantage in that the majority of light emitted by the plasma is able to be collected and focused by the reflector 1003. In particular the antenna is within the opaque body and does not shade any part of the light. It should also be noted that the bulb is surrounded by the vacuum in the enclosure 1020, whereby little heat is able to be conducted away from it and none is convected away. Thus the bulb is able to run hot. This is of advantage in the energy that might otherwise be dissipated as heat is available to maintain the high temperature of the plasma and the efficient emission of light.

The invention is not intended to be restricted to the details of the above described embodiments. For instance, the Faraday cage has been described as being reticular where lucent and imperforate around the alumina block and aluminium chassis block. It is formed from 0.12 mm sheet metal. Alternatively, it could be formed of wire mesh. Again the cage can be formed of an indium tin oxide deposit on the fabrication, suitably with a sheet metal cylinder surrounding the alumina and aluminium cylinders. Again where the fabrication and the alumina block are mounted on an aluminium chassis block, no light can leave via the alumina block. Where the alumina block is replaced with quartz, light can pass through this but not through the aluminium block. The block electrically closes the Faraday cage. The imperforate part of the cage can extend back as far as the aluminium block.

Indeed the cage can extend onto the back of the quartz with the aluminium block being of reduced diameter.

Another possibility is that there might be an air gap between the fabrication and the alumina block, with the antenna crossing the air gap to abut the fabrication.

Whereas above, the fabrication is said to be of quartz and the higher dielectric constant body is said to be of alumina; the fabrication could be of other lucent material such as polycrystalline alumina and the higher dielectric material body could also be of other ceramic material.

As regards frequency of operation, all the dimensional details above are for an operating frequency of 2.45 GHz. It is anticipated that since this LUWPL of the invention can be more compact at any specific operating frequency than an equivalent LER LUWPL, the LUWPLs of this invention will find application at lower frequencies such as 434 MHz (still within the generally accepted definition of the microwave range), due balance between greater size due to the longer wavelength of electromagnetic waves and reduced LUWPL size resulting from the invention. For 434 MHz frequency, a solid-state oscillator is expected to be feasible in place of a magnetron, such as is used in productions LUWPLs operating at 2.45 GHz. Such oscillators are expected to be more economic to produce and/or operate.

In all the above embodiments, the fabrication is asymmetric with respect to its central longitudinal axis, particularly due to its normally provided skirt. Nevertheless, it can be anticipated the fabrication could have such symmetry. For instance, the embodiment FIG. 20 would be substantially symmetric if the front seal were finished flush and it did not have a skirt.

Further, the above fabrications are positioned asymmetrically in the waveguide space. Not only is this because the fabrications are not arranged with the inter-region abutment plane P coincident with the semi-volume plane V, but also because the fabrication is towards one end of the waveguide space; whereas the separate solid dielectric material body is towards the other end. Nevertheless, it can be envisaged that the separate body could be united into the fabrication where it is of the same material. In this arrangement, the fabrication is not positioned asymmetrically in the waveguide space. Nevertheless it is asymmetric in itself, with a cavity at one end and being substantially voidless at the other to provided different end to end volume average of its dielectric constant.

Another possible variant is the provision of a forwards extending skirt on the aluminium carrier block. This can be provided with a skirt on the fabrication or not. With it, the Faraday cage can extend back outside the carrier block skirt and be secured to it. Alternatively, where the cage is a deposit on the fabrication, the carrier block skirted can be urged radially inwards onto the deposited cage material for contact with it.

What is claimed is:

1. A lamp being driven from a source of microwave energy, the lamp comprising:

a radiator for radiating microwave energy to a bulb, a fabrication of solid-dielectric, lucent material, the fabrication providing at least:

a closed void containing electromagnetic wave excitable plasma material;

a Faraday cage:

enclosing the fabrication, being at least partially lucent, for light transmission therefrom and delimiting a waveguide, the waveguide having:

a waveguide space, the fabrication occupying at least part of the waveguide space; and at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

the arrangement being such that there is:

a first region of the waveguide space extending between opposite sides of the Faraday cage at this region, this first region:

accommodating the inductive coupling means and having a relatively high volume average dielectric constant and a second region of the waveguide space extending between opposite sides of the Faraday cage at this region, this second region:

having a relatively low volume average dielectric constant and a microwave circuit having:

an input for microwave energy from the source thereof and an output connection thereof to the radiator in the fabrication, wherein the microwave circuit is a capacitive-inductive circuit configured as a bandpass filter and matching output impedance of the source of microwave energy to input impedance of the circuit, receptacle and bulb combination; and a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

2. The lamp according to claim 1, further including an additional tuning element provided in an iris between the PECs.

3. The lamp according to claim 1, wherein the metallic housing is plated internally to a depth of 6 microns or more with high electrical conductivity metal.

4. The lamp according to claim 1, wherein dielectric material between elements of the microwave circuit is one of air and ceramic material.

5. The lamp as claimed in claim 1, wherein the excitable plasma material containing void is arranged wholly within the second, relatively low average dielectric constant region.

6. The lamp as claimed in claim 1, wherein the excitable plasma material containing void is arranged to extend through the Faraday cage and be partially without the cage and the second region.

7. The lamp as claimed in claim 1, wherein the second region extends beyond the void in a direction from the inductive coupling means past the void.

8. The lamp as claimed in claim 1, wherein the fabrication has at least one cavity distinct from the plasma material void.

9. The lamp as claimed in claim 8, wherein the cavity extends between an enclosure of the void and at least one peripheral wall in the fabrication, the peripheral wall having a thickness less than the extent of the cavity from the enclosure to the peripheral wall.

10. The lamp as claimed in claim 1, wherein the fabrication has at least one external dimension which is smaller than the respective dimension of the Faraday cage, the extent of the portion of the waveguide space between the fabrication and the Faraday cage being empty of solid dielectric material.

11. The lamp as claimed in claim 1, wherein the fabrication is arranged in the Faraday cage spaced from an end of the waveguide space opposite from its end at which the inductive coupler is arranged.

12. The lamp as claimed in claim 1, wherein the solid dielectric material surrounding the inductive coupling means is one of the same material as that of the fabrication and a material of a higher dielectric constant than that of the fabrication's material, the higher dielectric constant material being in a body surrounding the inductive coupling means and arranged adjacent to the fabrication.

13. The lamp as claimed in claim 1, wherein the Faraday cage is lucent for light radiation radially thereof.

14. The lamp as claimed in claim 1, wherein the Faraday cage is lucent for light radiation forwardly thereof, that is away from the first, relatively high dielectric constant region of the waveguide space.

15. The lamp as claimed in claim 1, wherein the inductive coupling means is or includes an elongate antenna.

16. The lamp as claimed in claim 9, wherein the inductive coupling means is or includes an elongate antenna, and wherein:

the solid dielectric material surrounding the inductive coupling means is a material of a higher dielectric constant than that of the fabrication's material, the higher dielectric constant material being in a body surrounding the inductive coupling means and arranged adjacent to the fabrication;

the antenna is a plain wire extending in a bore in the body of relatively high dielectric constant material; and the cavity extends between an enclosure of the void and at least one peripheral wall in the fabrication, the peripheral wall having a thickness less than the extent of the cavity from the enclosure to the peripheral wall.

17. The lamp as claimed in claim 16, wherein the bore is a through bore in the said body with the antenna abutting the fabrication.

18. The lamp as claimed in claim 16, wherein a counterbore is provided in the front face of the separate body abutting the rear face of the fabrication and the antenna is T-shaped (in profile) with its T head occupying the counterbore and abutting the fabrication.

19. A lamp being driven from a source of microwave energy, the lamp comprising:

a radiator for radiating microwave energy to a bulb, a fabrication of solid-dielectric, lucent material, the fabrication providing at least:

an enclosure of a closed void containing electromagnetic wave excitable plasma material;

a Faraday cage:

enclosing the fabrication, being at least partially lucent, for light transmission therefrom and delimiting a waveguide, the waveguide having:

a waveguide space, the fabrication occupying at least part of the waveguide space and the waveguide space having an axis of symmetry; and at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the arrangement is such that with the waveguide space notionally divided into equal front and rear semi-volumes:

the front semi-volume is:

at least partially occupied by the fabrication with the said void in the front semi-volume and is enclosed (except at the rear semi-volume) by a front, lucent portion of the Faraday cage via which portion light from the void can radiate, the rear semi-volume has the inductive coupler extending in it and the volume average of the dielectric constant of the content of the front semi-volume is less than that of the rear semi-volume and a microwave circuit having:

an input for microwave energy from the source thereof and an output connection thereof to the radiator in the fabrication, wherein the microwave circuit is a capacitive-inductive circuit configured as a bandpass filter and matching output impedance of the source of microwave energy to input impedance of the circuit, receptacle and bulb combination; and a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

20. The lamp as claimed in claim 19, wherein the difference in front and rear semi-volume volume average of dielectric constant is caused by the said fabrication having end-to-end asymmetry and/or being asymmetrically positioned in the Faraday cage.

21. The lamp as claimed in claim 19, wherein:

the said fabrication occupies the entire waveguide space, at least one evacuated or gas-filled cavity is included in the fabrication within the front semi-volume, thereby providing the lower volume average of dielectric constant of the front semi-volume, the said at least one cavity being evacuated and/or gettered or gas filled or filled with nitrogen to a low pressure of the order of one half to one tenth of an atmosphere, and the cavity extends between the enclosure of the void and at least one peripheral wall in the fabrication, the peripheral wall having a thickness less than the extent of the cavity from the enclosure of the void to the peripheral wall.

22. The lamp as claimed in claim 19, wherein:

the said fabrication occupies a front part of the waveguide space, a separate body of the same material occupies the rest of the waveguide space and at least one cavity is included in the fabrication within the front semi-volume, thereby providing the lower volume average of dielectric constant of the front semi-volume, the said at least one cavity being evacuated and/or gettered or gas filled or filled with nitrogen to a low pressure of the order of one half to one tenth of an atmosphere, and the cavity extends between the enclosure void and at least one peripheral wall in the fabrication, the peripheral wall having a thickness less than the extent of the cavity from the enclosure of the void to the peripheral wall.

23. The lamp as claimed in claim 19, wherein:

the said fabrication occupies a front part of the entire waveguide space and a separate body of higher dielectric constant material occupies the rest or at least the majority of the waveguide space.

24. The lamp as claimed in claim 23, wherein:

at least one cavity is included in the fabrication within the front semi-volume, thereby enhancing the difference in the dielectric-constant, volume averages between the front and rear semi-volumes, the said at least one cavity being evacuated and/or gettered or gas filled or filled with nitrogen to a low pressure of the order of one half to one tenth of an atmosphere, and the cavity extends between the enclosure of the void and at least one peripheral wall in the fabrication, the peripheral wall having a thickness less than the extent of the cavity from the enclosure of the void to the peripheral wall.

25. The lamp as claimed in claim 19, wherein the enclosure void extends laterally of the cavity, crossing a central axis of the fabrication.

26. The lamp as claimed in claim 19, wherein the enclosure of the void extends on the central longitudinal, i.e. front to rear, axis of the fabrication.

27. The lamp as claimed in claim 19, wherein the enclosure of the void is connected to both a rear wall and a front wall of the fabrication.

28. The lamp as claimed in claim 19, wherein the enclosure of the void is connected to the front wall only of the fabrication.

29. The lamp as claimed in claim 19, wherein the enclosure of the void extends through a front wall of the fabrication and partially through the Faraday cage.

30. The lamp as claimed in claim 19, wherein a front wall of the fabrication is domed or flat and parallel to a rear wall of the fabrication.

31. The lamp as claimed in claim 19, wherein the enclosure of the void and the rest of the fabrication are of the same lucent material or the enclosure of the void and at least outer walls of the fabrication are of the differing lucent material.

32. The lamp as claimed in claim 30, wherein the outer wall(s) are of ultraviolet opaque material.

33. The lamp as claimed in claim 19, wherein the part of the waveguide space occupied by the fabrication substantially equates to the front semi-volume.

34. The lamp as claimed in claim 21, wherein:

the separate body abuts against a rear face of the fabrication and is located laterally by the Faraday cage or the separate body is spaced by an air gap from a rear face of the fabrication and is located laterally by the Faraday cage.

35. The lamp as claimed in claim 21, wherein:

the fabrication has a skirt with the separate body both abutting a rear face of the fabrication and being located laterally within the skirt.

36. The lamp as claimed in claim 1, wherein the void enclosure is tubular.

37. The lamp as claimed in claim 19, wherein the void enclosure is tubular.

38. The lamp as claimed in claim 1, wherein the fabrication and the separate body of solid dielectric material, where provided, are bodies of rotation about a central longitudinal axis.

39. The lamp as claimed in claim 19, wherein the fabrication and the separate body of solid dielectric material, where provided, are bodies of rotation about a central longitudinal axis.

40. The lamp as claimed in claim 1, wherein the fabrication and the separate body of solid dielectric material, where provided, are of rectangular cross-section.

41. The lamp as claimed in claim 19, wherein the fabrication and the separate body of solid dielectric material, where provided, are of rectangular cross-section.

42. A lamp being driven from a source of microwave energy, the lamp comprising:

a radiator for radiating microwave energy to a bulb, a fabrication of solid-dielectric, lucent material, the fabrication providing at least:

a closed void containing electromagnetic wave excitable plasma material;

a Faraday cage:

enclosing the fabrication, being at least partially lucent, for light transmission therefrom and delimiting a waveguide, the waveguide having:

a waveguide space, the fabrication occupying at least part of the waveguide space; and at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the fabrication is of quartz and a body of alumina is provided in the waveguide space to raise the volume average of the dielectric constant of the waveguide space, the inductive coupling means being provided in the alumina body and a microwave circuit having:

an input for microwave energy from the source thereof and an output connection thereof to the radiator in the fabrication, wherein the microwave circuit is a capacitive-inductive circuit configured as a bandpass filter and matching output impedance of the source of microwave energy to input impedance of the circuit, receptacle and bulb combination; and a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

43. The lamp as claimed in claim 42, wherein the fabrication and the alumina body together fill the waveguide space.

44. A lamp to be driven from a source of microwave energy, the lamp comprising:

a radiator for radiating microwave energy to a bulb, a fabrication of solid-dielectric, lucent material, the fabrication providing at least:

a closed void containing electromagnetic wave excitable plasma material;

a Faraday cage:

enclosing the fabrication, being at least partially lucent, for light transmission therefrom and delimiting a waveguide, the waveguide having:

a waveguide space, the fabrication occupying at least part of the waveguide space; and at least partially inductive coupling means including the radiator for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the volume average of the dielectric constant of the fabrication is less that the dielectric constant of its material and a microwave circuit having:

an input for microwave energy from the source thereof and an output connection thereof to the radiator in the fabrication, wherein the microwave circuit is a capacitive-inductive circuit configured as a bandpass filter and matching output impedance of the source of microwave energy to input impedance of the circuit, receptacle and bulb combination; and a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

45. A lamp being driven from a source of microwave energy, the lamp comprising:

a radiator for radiating microwave energy to a bulb, a fabrication of solid-dielectric, lucent material, the fabrication providing at least:

a closed void containing electromagnetic wave excitable plasma material;

a Faraday cage:

enclosing the fabrication, being at least partially lucent, for light transmission therefrom and delimiting a waveguide, the waveguide having:

a waveguide space, the fabrication occupying at least part of the waveguide space; and at least partially inductive coupling means including the radiator for introducing plasma exciting electromagnetic waves into the waveguide at a position at least substantially surrounded by solid dielectric material;

a body of solid dielectric material in the waveguide space, the body abutting the fabrication and having the inductive coupling means extending in it, whereby on introduction of electromagnetic waves of a determined frequency a plasma is established in the void and light is emitted via the Faraday cage and a microwave circuit having:

an input for microwave energy from the source thereof and an output connection thereof to the radiator in the fabrication, wherein the microwave circuit is a capacitive-inductive circuit configured as a bandpass filter and matching output impedance of the source of microwave energy to input impedance of the circuit, receptacle and bulb combination; and a tunable comb line filter; and wherein the microwave circuit comprises:

a metallic housing;

a pair of perfect electric conductors (PECs), each grounded inside the housing a pair of connections connected to the PECs, one for input and the other for output and a respective tuning element provided in the housing opposite the distal end of each PEC.

46. The lamp as claimed in claim 45, wherein the inductive coupling means extends as far as the abuttal interface between the body and the fabrication.

47. The lamp as claimed in claim 45, wherein the fabrication and the body are of the same material.

48. The lamp as claimed in claim 45, wherein the fabrication and the body are of differing materials, the body having a higher dielectric constant.

* * * * *